US005338508A

United States Patent [19]

Nitta et al.

[11] Patent Number: 5,338,508

[45] Date of Patent: Aug. 16, 1994

[54] ALLOY STEEL POWDERS FOR INJECTION MOLDING USE, THEIR COMPOUNDS AND A METHOD FOR MAKING SINTERED PARTS FROM THE SAME

[75] Inventors: Minoru Nitta; Yoshisato Kiyota; Yukio Makiishi; Hiroshi Ohtsubo; Toshio Watanabe; Yasuhiro Habu, all of Chiba, Japan

[73] Assignee: Kawasaki Steel Corporation, Japan

[21] Appl. No.: 962,607

[22] Filed: Oct. 16, 1992

Related U.S. Application Data

[63] Continuation of Ser. No. 799,755, Nov. 27, 1991, abandoned, which is a continuation of Ser. No. 377,903, Jul. 10, 1989, abandoned.

[30] Foreign Application Priority Data

Jul. 13, 1988 [JP] Japan ..... 63-172532
Aug. 20, 1988 [JP] Japan ..... 63-206719
Aug. 20, 1988 [JP] Japan ..... 63-206720

[51] Int. Cl.[5] ..... C22C 38/02; C22C 38/04; C22C 38/10

[52] U.S. Cl. ..... 420/120; 420/121; 420/127; 420/435; 420/581; 75/246; 75/255

[58] Field of Search ..... 75/246, 255; 420/34, 420/43, 52, 55, 104, 107, 435, 581, 120, 121, 123

[56] References Cited

U.S. PATENT DOCUMENTS 4,353,742 10/1982 Crook ..... 420/585
4,415,532 11/1983 Crook ..... 148/442
4,489,040 12/1984 Asphahani et al. ..... 420/584
4,497,669 2/1985 Wang et al. ..... 148/11.5 P
4,778,513 10/1988 Kemp, Jr. et al. ..... 75/342
4,783,215 11/1988 Kemp, Jr. et al. ..... 75/342

FOREIGN PATENT DOCUMENTS 3704473 8/1988 Fed. Rep. of Germany .
62-294149 12/1987 Japan .

OTHER PUBLICATIONS

Effects of Si, Mn and C on metallurigical properties of water atomized SUS 316 stainless steel powders, T. Kato and K. Kusaka, "Powders and Powder Metallurgy 22(1)" pp. 1–31, Mar. 1975.

*Primary Examiner*—George Wyszomierski
*Attorney, Agent, or Firm*—Austin R. Miller

[57] ABSTRACT

There is provided alloy steel powders for the injection molding use manufactured by the atomizing method which are characterized by their substantially spherical particle shape and average particle diameters of 20 microns or less, a compound for the injection molding use which contains the alloy steel powders and one or more organic binders, a process for manufacturing sintered materials in performing injection molding of compound and subsequently debinding the obtained injection molded part followed by sintering the debound part, at least the first stage of the sintering step is performed in reduced pressure atmosphere, and the sintered material having a relative density ratio of 92% or more.

2 Claims, 9 Drawing Sheets

ALLOY STEEL POWDERS FOR INJECTION MOLDING USE, THEIR COMPOUNDS AND A METHOD FOR MAKING SINTERED PARTS FROM THE SAME

This application is a continuation of application Ser. No. 07/799,755, filed Nov. 27, 1991, which is a continuation of application Ser. No. 07/377,903, filed Jul. 10, 1989, all now abandoned.

BACKGROUND OF THE INVENTION

The present invention relates to metal powders for injection molding use, their compounds and the method for producing sintered parts from the same.

(1) Sintered steel, which is a kind of sintered metal body, is partially replacing ingot stainless steel, since the former offers advantages over the latter with respect to improvement of the yield and reduction of machining cost.

With regard to the molding method for the sintered steel, great hopes are entertained of such injection molding methods that will readily enable molding of parts having complex three-dimensional configurations in place of the compression molding whose limitation is that the producible parts are limited to those of two-dimensional designs.

However, since the manufacture of sintered steel bodies by injection molding was started only recently, there are still a variety of technical problems which remain unresolved, and, in particular, there is room for major improvement in the raw material powder.

Generally, it is requisite for the raw material powder for injection molding of a 20 microns or less average particle diameter that it is in the spherical shape and in the form of fine particles. An advantage of the spherical powder is that it imparts good slip among the particles, that is to say, it has excellent injection moldability. For instance, by comparison of a spherical powder with an irregular shape powder, both of which have been added with an organic binder of an identical kind and in an identical quantity, it is found that the former offers a lower viscosity and demonstrates better injection moldability. Furthermore, an equivalent level of injection moldability can be achieved with a lower quantity of the binder. For the said reasons, it becomes possible to shorten the debinding cycle, and also to achieve a high density by dint of a finer particle size of the powder.

For the purpose of achieving such properties required of the raw material powder, modification of operational parameters for the atomizing apparatus, e.g. the pressure and flow rate of the atomizing medium and adjustment of the diameter of the metallic melt injection nozzle, has been the conventionally adopted means. However, no other means for the intended improvement has been adopted through the route of altering the chemical composition of the raw material powder, but such chemical composition that is similar to that adopted for the raw material powder intended for compression molding, whose average particle diameter is about 80 microns, that is to say, the chemical composition form, in which such impurities as may interfere with compressiblity in the case of compression molding have been removed to the bare minimum, has been conventionally adopted.

Nonetheless, problems have been experienced in that satisfactory injection moldability cannot be achieved with fines for injection molding of the conventional chemical composition (Ref.: The "Tokushu-ko (Special Steel)", Vol.36, No.6, page 52, Table 1, Jun. 1, 1987), since spherical particle formation does not take place to a sufficient extent in that powder.

(2) The present circumstance is that being in current use as a raw material powder for the injection molding use are those powders which are essentially sintering fine powders for the compression molding use as described in the Japanese Patent Publication No. 1761/84, the "Funtai Oyobi Funmatsu Yakin (Powders and Powder Metallurgy)", Vol. 12, No. 1 (February, 1965), page 25 to page 32, by Tamura et al. and the "Funtai Oyobi Funmatsu Yakin", Vol. 22, No. 1 (March, 1975), page 1 to page 11, by Kato et al., but have chemical compositions not at all different from those of the powders intended for powder metallurgy, namely, comprising 1.5% or less by weight of silicon, 0.4% or less by weight of manganese, and less than 1 Manganese/Silicon ratio(ordinarily, the Manganese/Silicon ratio is less than 0.3).

What has remained problematic is that the said powders are not necessarily satisfactory with respect to the injection moldability and the sintering characteristics, since the traditional technological philosophy centering on prevention of oxidation in the atomizing step by keeping the Manganese/Silicon ratio at less than 0.3 has been followed strictly so that chemical compositions having extremely reduced contents of carbon and manganese, which deteriorate the compressibility and moldability in the compression molding operation, have been conventionally used, while such practice resulted in insufficient development of such expertise for producing spherical powder and handling oxides on the surface, which is required of stainless steel powder (the average particle diameter: 20 microns or less).

(3) Iron-Cobalt-type alloy is known as a soft magnetic material having the highest saturated magnetic flux density among all magnetic materials. In other words, Iron-Cobalt-type alloy can be said to exhibit a higher magnetic energy with a given volume among all magnetic materials. Great hopes are entertained of this material, by virtue of its excellent magnetic characteristics, for applications associated with electric motors, magnetic yoke, and the like which require high magnetic energy generated from small-size parts.

On the other hand, ingot Iron-Cobalt-type alloy is in such a dilemma that industrial production of small-size parts is virtually impossible due to its poor cold workability.

Powder metallurgy is considered to be a valid means by which to overcome such inferior workability, and variety of methods have been proposed. For instance, there are the Japanese Patent Laid Open No. 291934/86, the Japanese Patent Laid Open No. 54041/87, and the Japanese Patent Laid Open No. 142750/87 concerning Iron-Cobalt-type sintered materials, and the Japanese Patent Publication No. 38663/82 (The Japanese Patent Laid Open No. 85649/80) concerning Iron-Cobalt-type sintered materials containing phosphorus and the japanese Patent Laid Open No. 85650/80 concerning Iron-Cobalt-type sintered materials containing boron. Furthermore, there is the Japanese Patent Laid Open No. 75410/79 concerning Iron-Cobalt-Vanadium-type sintered materials.

However, all of the hitherto proposed methods, which depend on the principle of compression molding, are accompanied by such limitation that so-called mixed powder, namely, a powder prepared by admixing iron-cobalt alloy powder, cobalt-vanadium alloy powder, iron-phosphorus alloy powder, and/or iron-boron alloy powder with iron powder and cobalt powder, so that the raw material powder will enable molding in a mold for the compression molding press, while the admixing or blending ratio had to be limited to an extent that does not deteriorate the compressibility.

For the said reason, it has been the object of the conventional technique to overcome low sintered density and low magnetic characteristics attributable to the said limitations. The method proposed in the Japanese Patent Laid Open No. 291934/86 is intended for improvement in the compressibility by utilizing rapidly quenched iron-cobalt alloy, in which no regular lattice structure is formed, as well sinterability by dint of the blend of such rapidly quenched iron-cobalt alloy powder with cobalt powder, the method proposed by the Japanese Patent Laid Open No. 54041/87 is for improvement in the sintered density by HIP (hot isostatic press) Method, and the method proposed by the Japanese Patent Laid Open No. 142750/87 aims at improvement in the magnetic characteristics by means of improved green density (compressed powder density) and sintered density by combination of coarse Iron-Cobalt-type alloy powder with cobalt fines.

There are methods proposed in the Japanese Patent Publication No. 38663/82 (The Japanese Patent Laid Open No. 85649/80) and the Japanese patent Laid Open No. 85650/80, both of which are intended for improving magnetic characteristics by means of achieving high sintered density that unblended powders. The former method comprises sintering a pulverized iron-phosphorus alloy (26.5% by weight of P) so that the phosphorus content will be 0.05 to 0.7%. The latter method comprises sintering of pulverized iron-boron alloy (19.9% by weight of B) so that the boron content will be 0.1 to 0.4%.

Furthermore, the sintered material disclosed in the Japanese Patent Laid Open No. 75410/79 is intended to improve magnetic characteristics by increasing the sintered density of Iron-Cobalt-Vanadium-type alloy as sintering material through liquid phase sintering of a composition prepared by blending pulverized vanadium-cobalt alloy ground powder consisting of 35 to 45% by weight of vanadium, comprising 38% vanadium eutectic composition, with iron powder and cobalt powder. The conventional methods as proposed hereinabove are, however, intended for compression molding using a mold, and are not applicable to injection molding, since the raw material powder is essentially a mixture of various single-element metal coarse powders having inferior sintering characteristics and two-element alloy powders, and said powders differ from one another in the particle size and the particle shape due to difference in the manufacturing methods employed.

In the present days, Iron-Cobalt-type sintered material is replacing a part of the ingot iron-cobalt alloy material on account of the former's advantage with respect to the yield and the machining cost. In particular, with regard to the molding process, expectation is entertained of future development of the injection molding method which is capable of readily giving three dimensional profile parts, substituting the compression molding method which is merely capable of producing two dimensional parts.

Nevertheless, since it is only recent that the manufacture of Iron-Cobalt-type sintered material, depending on the injection molding technique, was started, there still remain various technical problems which are yet to be resolved. In particular, with regard to raw material powder, there is much to be improved.

Generally, the raw material powder intended for injection molding is required to be fines in the spherical particle shape, and has oxides on the surface of the particle which can be reduced, in the case of Iron-Cobalt-type sintered material as was described in relation to the Stainless Steel-type sintered material.

However, even in the case of Iron-Cobalt-type sintered material, alteration of the chemical composition of the raw material powder has not been adopted as a means for realizing improvement, as was the case with Stainless Steel-type sintered material, but a same composition as the raw material powder (having an average particle diameter of about 80 microns) predicated on an assumption that it be used for the compression molding only has been adopted.

Namely, chemical compositions in which such impurities as will deteriorate the compressibility and the processability in the compression molding step have been conventionally used. However, there existed problems in that said chemical compositions are not necessarily satisfactory with respect to the injection moldability and sintering characteristics, since there are not available sufficient knowledge and experiences regarding the method by which to obtain the spherical particle shape and oxides on the surface for the fine powder for the injection molding use having the conventional composition (the average particle diameter is 20 microns or less).

BRIEF DESCRIPTION OF THE DRAWINGS

FIG. 1 (*b*) is a graph which shows a relationship between the carbon content and the tap density.

FIG. 1 (*c*) is a graph which shows a relationship between the carbon content and the specific surface area.

FIG. 1 (*d*) is a graph which shows a relationship between the carbon content and the viscosity temperature.

SUMMARY OF THE INVENTION

Figure 1:
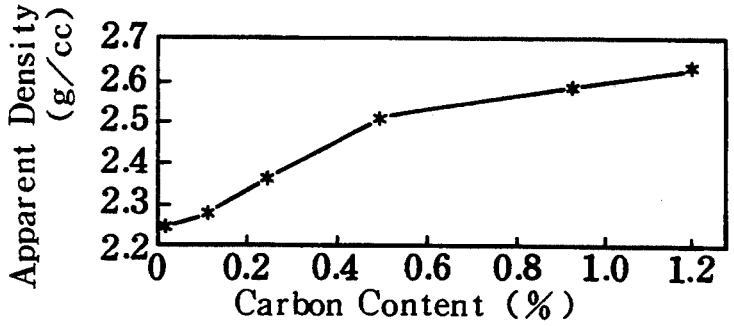
FIG. 1 (*a*) is a graph which shows a relationship between the carbon content and the apparent density.
Figure 1:
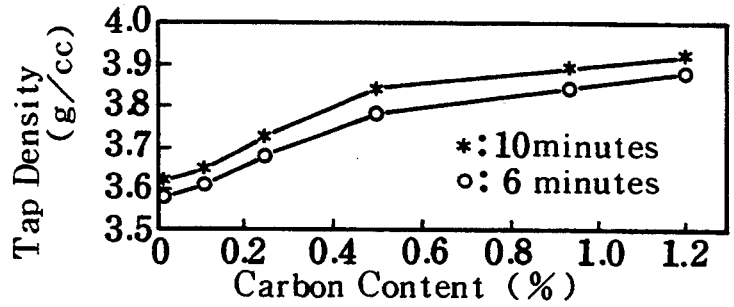
Figure 1:
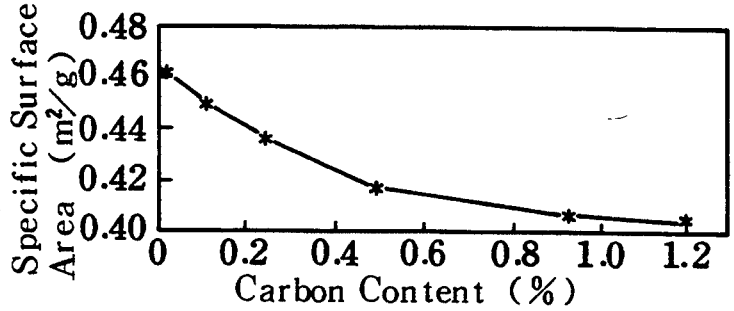
Figure 1:
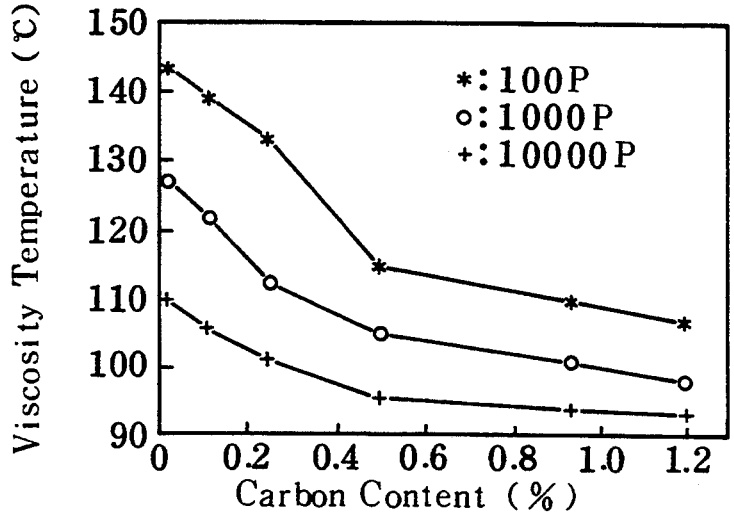

The present inventors, by way of carrying out elaborate experiments relating to the manufacture of stainless steel powder as a raw material for sintered steel and the manufacture of sintered steel by injection molding, have engaged in search for such chemical compositions that will not at all impair the corrosion resistance of the sintered body and also will give the spherical particle shape as powder which is suitable for injection molding. The present inventors thereby have completed the present invention.

The object of the present invention is to provide a stainless steel powder of the spherical particle shape having excellent injection moldability in the manufacture of sintered stainless steel parts which depend on injection molding, and a method for producing sintered stainless steel having excellent corrosion resistance, utilizing the said raw material powder.

Another object of the present invention is to provide a stainless steel fine powder which is in the spherical particle shape, namely, a suitable particle shape to achieve good injection moldability for metal powders, and comprised reducible oxides on the surface of the particle, thus imparting excellent sintering characteristics.

Another object of the present invention is to provide sintered stainless steel material having excellent corrosion resistance by means of injection molding, sintering and, depending on the need, by making HIP (hot isostatic press) treatment of the said stainless steel powder.

Still another object of the present invention is to provide Iron-Cobalt-type alloy fine powder and Iron-Cobalt-type fine powder having the spherical particle shape which imparts suitable injection moldability for metal powder and having excellent sintering characteristics by virtue of the reducible oxides on the surface of the particle, and, furthermore, to provide a sintered iron-cobalt material having useful magnetic characteristics, in particular, high saturation magnetic flux density by injection molding the said alloy fines, sintering the injection molded part thereby obtained, and depending on the need, performing an HIP treatment of the sintered part.

The present inventors have acquired the following knowledge after having carried out elaborate experiments aimed at accomplishing the above-mentioned objects, and have come upon the present invention.

(1) In the manufacture of sintered stainless steel parts, for which the injection molding method is utilized, different from the melt process to obtain molded stainless steel parts, sintered parts having high density can be obtained by increasing the carbon content of stainless steel fine powder, rather than decreasing the same, and employing a certain sintering method.

(2) Stainless steel powders of an average particle diameter of 20 microns (as herein used, the "average particle diameter" means a particle diameter of the particle size group (powder fraction) with whose addition the cumulative volume measured from the finer particle group reaches the 50% level of the total volume) which have particle shapes suitable for injection molding and such surface construction (the surface comprising a certain oxide composition) as gives excellent sintering characteristics are producible by atomizing the melt consisting of a chromium-containing stainless steel having the composition of 0.20% or more by weight of silicon and a Manganese/Silicon ratio of 1.00 or higher, and a Chromium-type stainless steel having the composition of 1.20% or less by weight of carbon, 0.20% or less by weight of silicon, a Manganese/Silicon ratio of 1.00 or higher, and 8.0 to 30.0% by weight of chromium, or Chromium-Nickel-type stainless steel having the composition of 8.0 to 30.0% by weight of chromium and 8.0 to 22.0% by weight of nickel.

As shown in detail by Examples of the present invention, it is possible to obtain by sintering stainless steel powder having the above-mentioned compositions sintered stainless steel materials constructed with closed pores which have a relative density ratio (the ratio to true density) of 92% or higher and excellent corrosion resistance with their 0.05% or less by weight carbon contents.

Also, an improvement is achieved in the corrosion resistance of the sintered stainless steel material at carbon content levels of 0.05% or lower by weight by means of alloying with Chromium-type stainless steel or Chromium-Nickel-type stainless steel one or more of 1.0 to 4.0% by weight of nickel, 0.3 to 4.0% by weight of molybdenum, and 0.5 to 5.0% by weight of copper.

Moreover, an improvement is achieved in the cutting efficiency of the sintered stainless steel at carbon content levels of 0.05% or lower by weight by means of alloying with Chromium-type stainless steel or Chromium-Nickel-type stainless steel with one or more of 0.05 to 2.00% by weight of tin, 0.02 to 0.05% by weight of sulfur, 0.05 to 0.20% by weight of selenium, and 0.05 to 0.20% by weight of tellurium.

(3) It is possible to manufacture iron-cobalt fine powder of an average particle diameter of 20 microns or less having a particle shape suitable for injection molding and comprising the surface (the surface containing a certain oxide composition) which imparts excellent sintering characteristics by means of producing metal fines by the atomizing method from an iron-cobalt melt, the composition of which being 2.00% or less by weight of manganese, and 15 to 60% by weight of cobalt, the balance being substantially iron except impurities. Accordingly, it is possible to obtain by sintering the above-mentioned alloy fine powder sintered material containing closed pores and superior in magnetic characteristics which has a relative density ratio (the ratio to true density) of 92% or higher and has a carbon content of 0.02% or less by weight.

Also, it is possible to manufacture Iron-Cobalt-type or Iron-Cobalt-Vanadium-type powder of an average particle diameter of 20 microns or less having a particle shape suitable for injection molding and comprising the surface of the particle (the surface containing a certain oxide composition) which imparts excellent sintering characteristics by means of producing metal fines by the atomizing method from Iron-Cobalt-type or Iron-Cobalt-Vanadium-type melt, the composition of which being 1.00% or less by weight of carbon, 1.00% or less by weight of silicon, 2.00% or less by weight of manganese, and 1.00 or higher Manganese/Silicon ratio. Accordingly, it is possible to obtain by sintering the above-mentioned alloy powder sintered material having closed pores and superior in magnetic characteristics which has a relative density ratio (the ratio to true density) of 92% or higher and has a carbon content of 0.02% or less by weight.

Moreover, an improvement can be achieved in the apparent density and the tap density of the alloy powder of an average particle diameter of 20 microns or less and in magnetic characteristics at carbon content levels of 0.02% or lower by weight in accordance with increase in the sintered density by means of alloying with the above-mentioned melt one or both of 0.02 to 1.00% by weight of boron, 0.05 to 1.00% by weight of phosphorus and atomizing the alloy into fine powder.

DETAILED DESCRIPTION OF THE INVENTION

(A) Metal fine powder for the injection molding use

(1) Stainless steel powder

The composition of the stainless steel powder offered to uses in the manufacture of sintered stainless steel by injection molding is in the present invention based on a carbon content of 0.1 to 1.0% by weight, the other elements as constituents being the same as those of the known stainless steel.

Generally, in the case of ingot stainless steel, it is necessary to reduce the carbon content to the bare minimum from the view point of ensuring an acceptable corrosion resistance. In particular, raw material powders which are offered to the manufacture of sintered stainless steel by compression molding are required to have carbon content reduced to an extent lower than that of ingot steel, from the view point of ensuring corrosion resistance as well as compressibility in compression molding.

On the other hand, it was found that in the manufacture of sintered stainless steel, use of low carbon raw material powder does not lead to improved injection moldability and does not offer any merit with respect to corrosion resistance due to contamination with carbon which is produced from the organic binder after the debinding stage.

Moreover, it was found that the carbon resulting from raw material powder as well as the carbon resulting from the organic binder can be removed by performing sintering in a reduced pressure atmosphere.

Thus, it was newly found through an attempt to improve properties of raw material powder by means of increasing carbon contained in the stainless steel powder, rather than reducing it, that the increased carbon content leads to improved compactness of the powder produced by the atomizing method utilizing a high pressure medium, namely, formation of spherical particle shape.

Set forth hereinunder is an explanation of the reasons why the carbon content must be limited.

For the purpose of evaluating the degree of sphericity in the powder, relationships between the carbon content on one hand and the apparent density, the tap density, the specific surface area, and the compound viscosity, respectively, on the other were examined as for the stainless steel powders whose chemical compositions, except carbon, correspond to SUS316 in the Japan Industrial Standard(JIS). It can be learned that the apparent density and the tap density reveal the degree of sphericity according to the compactness of powder, the specific surface area is a useful general indicator of the degree of sphericity in the powder, and the compound viscosity is a property that is directly required from the injection moldability's point of view and also represents the slip property of the compound, from which the degree of sphericity can be assessed.

Results of the above-mentioned evaluation are shown in FIGS. 1 (*a*) through (*d*). Increases in the tap density and the apparent density and an increase in the specific surface area are recognized at the carbon content level of 0.1% or higher with powders having generally the same particle size distribution, whereby it is learned that particles of the powder are in the spherical shape. Moreover, as is obvious from FIG. 1 (*d*), there is recognized an effect of lowering the viscosity at carbon content levels of 0.1% or higher with compounds having equivalent powder vs. binder ratios. Therefore, the lower limit of the carbon content is set at 0.1%.

Figure 2:
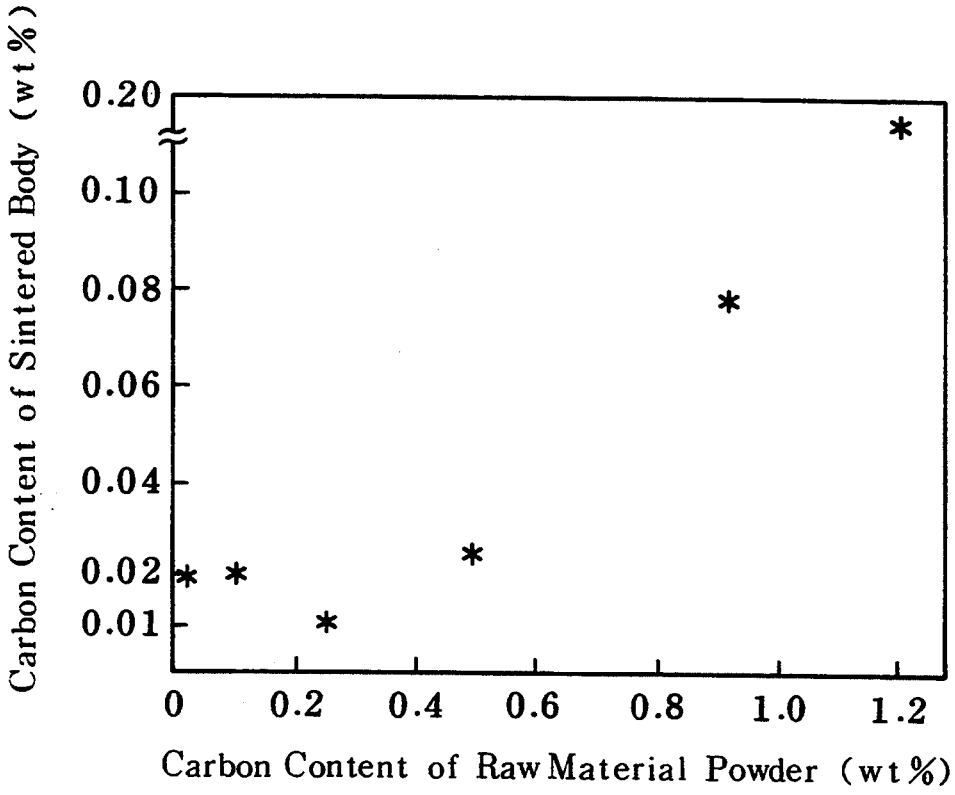
FIG. 2 is a graph which shows the carbon content after sintering.

Moreover, relationships between the carbon content of a sintered material obtained by molding a mixture of the stainless steel powder having the same chemical composition as that of the sample used in the above-mentioned experiment and a thermoplastic binder, and then sintering the said molded material by a vacuum (0.0001 torr) sintering process which is generally industrially practicable for 4 hours is shown in FIG. 2. The upper limit of the carbon content of the sintered material cannot be reduced sufficiently if the carbon content exceeds the level of 1.0%, as it is so obvious from the same Figure. Therefore, the upper limit of the carbon content is set at 1.0%.

Thus, by limiting the carbon content of the powder, it is possible to obtain raw material powder which favorably suits the manufacture of sintered stainless steel by injection molding.

Moreover, the chemical composition of the steel powder of this invention offers not only excellent powder properties, but also good economics in the manufacture, since the declines of viscosity and melting point of the molten meal by addition of carbon makes it possible to lower the molten metal treating temperature and to shorten the atomizing cycle.

The composition of the stainless steel powder of the present invention can be generally applicable to compositions of Chromium-containing stainless steel, including Austeinite-type or Ferrite-type stainless steel like, for example, SUS316, SUS304 and SUS410 of JIS, and can be used with carbon added to the composition of the known sheet form material or conventional powders for powder metallurgy. The above-mentioned effect is attributed to the fact that physical properties of the molten metal such as the viscosity can be uniformly altered by adding carbon to the molten metal having the composition of stainless steel, and achieve uniform spherical particle formation in the atomized powder, since the form of particles in the powder manufactured by the atomizing process is strongly influenced by physical properties of the molten metal such as the viscosity.

Moreover, it is essential that the particle size of the powder in terms of the average particle diameter for injection molding is 20 microns or less, and it is preferable that powders having an average particle diameter of 10 microns or less is used for the purpose of achieving high levels of density for the finally obtained sintered parts. Next, the above-mentioned stainless steel powder is added with an organic binder to prepare a compound for injection molding.

(2) Silicon-containing alloy powder

The composition of silicon-containing alloy powder offered to uses in the manufacture of sintered silicon-containing allow material by injection molding is preferably based on 1.20% or less by weight of carbon, 0.20% or more by weight of silicon, 1.00 or higher Manganese/Silicon ratio, and 20 microns or less average particle diameter.

More preferably, it is 1.2% or less by weight of carbon, 0.20% or more by weight of silicon, 1.00 or higher Manganese/Silicon ratio, and 8.0 to 3.00% by weight of chromium, the balance being substantially iron except impurities, with an average particle diameter of 20 microns or less.

(a) Moreover, the above-mentioned composition may contain 1.0 to 4.0% by weight of nickel or 8.0 to 22.0% by weight of nickel.

(b) Or, the above-mentioned composition may contain 0.3 to 4.0% by weight of manganese, without containing nickel. It may contain 0.3 to 4.0% by weight of molybdenum in addition to the nickel therein contained.

(c) Or, the above-mentioned composition may contain 0.5 to 5.0% by weight of copper, without containing nickel. It may contain 0.5 to 5.0% by weight of copper in addition to the nickel therein contained.

(d) Or, the above-mentioned composition may contain 0.3 to 4.0% by weight of molybdenum and 0.5 to 5.0% by weight of copper in addition to 1.0 to 4.0% by weight of nickel or 8.0 to 22.0% by weight of nickel therein contained.

(e) Moreover, the composition as set forth in (a) through (d) above may contain one or more of 0.05 to 2.00% by weight of tin, 0.02 to 0.50% by weight of sulfur, 0.05 to 0.20% by weight of selenium and 0.05 to 0.20% by weight of tellurium.

The reasons for limiting the carbon content to 1.20% or less by weight are set forth below.

Generally, in the case of ingot stainless steel, it is necessary to reduce the carbon content to the bear minimum from the view point of ensuring an acceptable corrosion resistance. In particular, raw material powders which are offered to the manufacture of sintered stainless steel by compression molding are required to have its carbon content reduced to an extent lower than that of ingot steel, from the view point of ensuring corrosion resistance as well as compressibility in the compression molding.

On the other hand, it was found that in the manufacture of sintered stainless steel, use of low carbon raw material does not lead to improved injection moldability and does not offer any merit with respect to corrosion resistance due to contamination with carbon which is produced from organic binder at the debinding stage.

Moreover, it was found that the carbon resulting from raw material powder as well as the carbon resulting from the organic binder can be removed by performing sintering in vacuum.

Thus, an attempt was made to improve properties of the powder by increasing the carbon content of the powder, rather than reducing the same. As a result, it was found through the experiments that addition of the carbon content improves the compactness of powder obtained by the atomizing method for which high pressure medium is utilized (for formation of the spherical particle shape).

It is inferred that the atomized particle is shaped into the spherical shape by dint of the decline in the oxygen content of the melt which is caused by the carbon's getting alloyed with constituents of stainless steel in the melt form and also the decline in the viscosity and melting point of the melt. For example, it is learned that in stainless steel fine powder obtained by atomizing the melt with circular water jet injected at a 1,000 Kgf/cm$^2$ water pressure having an average particle diameter of 8.0 to 9.0 microns as shown in Table 1 through Table 3, its apparent density and tap density are recognized to increase in accordance with the increase in the amount of carbon alloy, hence the spherical particle formation is known to have taken place in the powder.

Furthermore, even in the case of compounds having equivalent powder-to-binder ratio, it is recognized that the viscosity temperature of the compound declines in consequence of increases in the alloyed carbon content of the stainless steel powder.

However, the viscosity temperature of the compound increases remarkably, if the alloyed carbon content of the stainless steel powder exceeds the level of 1.20% by weight, since the limit of deoxidation owing to the carbon-wit-oxygen reaction is lowered to below the limit of deoxidation corresponding to amounts of silicon and manganese alloyed in the melt in consequence of the decline in the melt temperature at the time of introduction of the melt for the atomizing stage, thus causing the apparent density and the tap density to drop on the contrary due to production of bubble-like particles in which carbon monoxide gas is encapsulated.

Moreover, the alloyed carbon content of the stainless steel powder is limited to 1.20% or less by weight, since in case the said compound undergoes vacuum sintering and maximum sintering time which are ordinarily adopted industrially, namely, at 1,350° C. and for 4 hours, the carbon content of the sintered material cannot be reduced to 0.05% or less by weight, and, consequently, the corrosion resistance is deteriorated.

The reasons for limiting the Manganese/Silicon ratio to 1.00 or higher for 0.20% or more by weight of silicon are set forth below.

Although the melt alloyed with chromium causes clogging of the tundish nozzle with chromium oxide ($Cr_2O_3$) which precipitates on the tundish nozzle due to drop of the melt temperature, with addition of C, Si and Mn to the melt, it is possible to adjust the oxygen content of the melt to below the Cr-O deoxidation limit, which reaches the equilibrium at the melt temperature when melt passes through the tundish nozzle, and thus the nozzle clogging can be prevented.

For instance, in case manganese is not added to the stainless steel melt of 0.01% by weight of carbon and 30.0% by weight of chromium maintained at 1,500° C., the oxygen contents of Cr-O and Si-O in the melt reach approximity of the equilibrium at 0.20% by weight of Si content and the melt passes through the tundish nozzle without clogging it, thus making atomization possible. Hence, the silicon content is limited to 0.20% or more by weight.

Moreover, if manganese is added to the melt, a further satisfactory condition can be achieved by virtue of a complex deoxidation effect of Si-Mn in that the melt is made into one having a low oxygen content compared with the limit of Cr-O deoxidation, thus eliminating the possibility of clogging the tundish nozzle due to dropped melt temperature.

For instance, the spherical particle formation is known to have occurred at a Manganese/Silicon ratio of 1.00 or higher in the case of the alloy powder obtained by atomizing the melt with water jet as shown in Table 1 through Table 3, since both apparent and tap densities increase and the viscosity temperature of the compound is lowered. Moreover, it is also learned that the sintered density increases and the surface has been made into a condition which imparts fair sinterability when the Manganese/Silicon ratio is 1.00 or higher.

It is inferred that if the manganese content of the melt increases, MnO of a low melting point is produced on the surface of the particle in the atomization step, and before the MnO solidifies, lowering of the melting point of the surface layer of the particle, increase in the surface tension, and decline of the viscosity occur, and consequently the atomized particle assumes the spherical shape.

Moreover, the MnO is considered to be reduced into carbon monoxide by the carbon content of the compound or the alloyed carbon content of the melt, thus not obstructing sintering, so long as the said compound undergoes vacuum sintering at about 1,350° C., which is the sintering temperature generally adopted industrially.

On the contrary, silicon produces viscous silicon dioxide ($SiO_2$) on the surface of the particle in the atomizing stage to make the particle shape irregular, and the silicon dioxide can hardly undergoes reduction into carbon monoxide with carbon in vacuum at a temperature of about 1,400° C., hence sintering is obstructed. Therefore, the Manganese/Silicon ratio of the melt is limited to 1.00 or higher for the purpose of achieving spherical particle formation and a surface of the particle which imparts a fair sinterability in the atomizing stage.

The reasons for limiting the chromium content to 8.0 to 30.0% by weight are set forth below.

Figure 4:
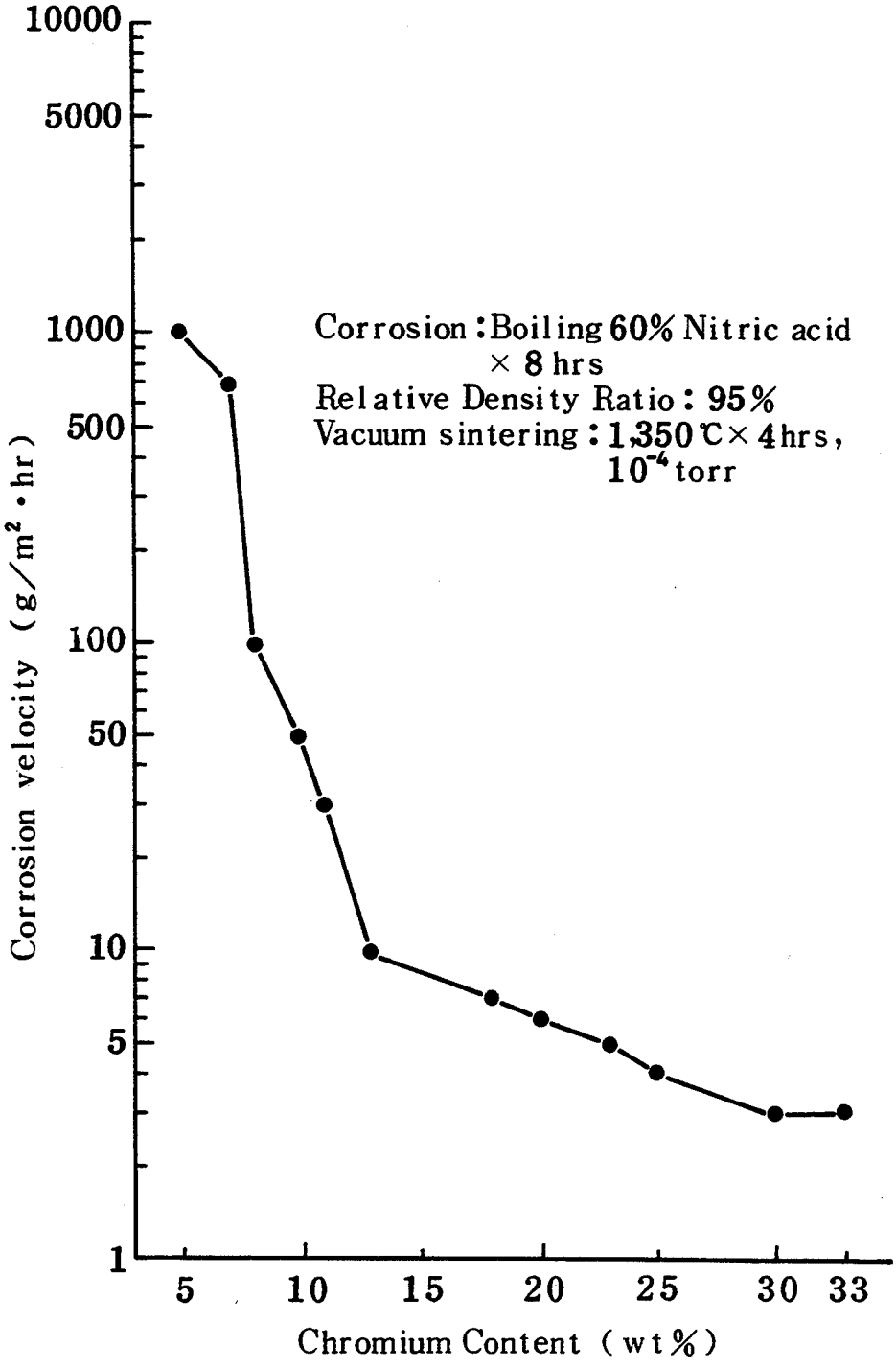
FIG. 4 is a graph which shows a relationship between the chromium (as alloy) content of Ferrite-type stainless steel sintered material and the corrosion velocity in a boiling 60% nitric acid solution.

Chromium is a basic alloy element of stainless steel, which forms the passive state film and imparts corrosion resistance. The chromium content is limited to 8.0 to 30.0% by weight, since addition of chromium in an amount exceeding 30% by weight does not bring about any improvement in the corrosion resistance, while the corrosion velocity remarkably decreases at the chromium content level of 8.0% or higher by weight, in the case of sintering a material constructed with closed pores having a specific density ratio of 95% which iis obtained by injection molding Chromium-containing powder of an average particle diameter of 8.0 ti 9.0 microns (5.0 to 33.0% by weight of chromium, 0.02% by weight of carbon, 0.70% by weight of silicon, 1.00% by weight of manganese, 0.02% by weight of phosphorus, and 0.01% by weight of sulfur, the balance being substantially iron) and vacuum sintering the said injection molded material in vacuum at 1,350° C. for 4 hours at $10^{-4}$ torr, according to the corrosion resistance test carried out on samples immersed in a boiling nitric acid as shown in FIG. 4, which represents results of elaborate studies made by the present inventors.

The reason for limiting the nickel content of Ferrite-type sintered steel to 1.0 to 4.0% by weight are set forth below. The process of achieving the passive state in Chromium-containing sintered ferrite steel is enhanced by nickel, and the corrosion resistance is thereby improved.

Figure 5:
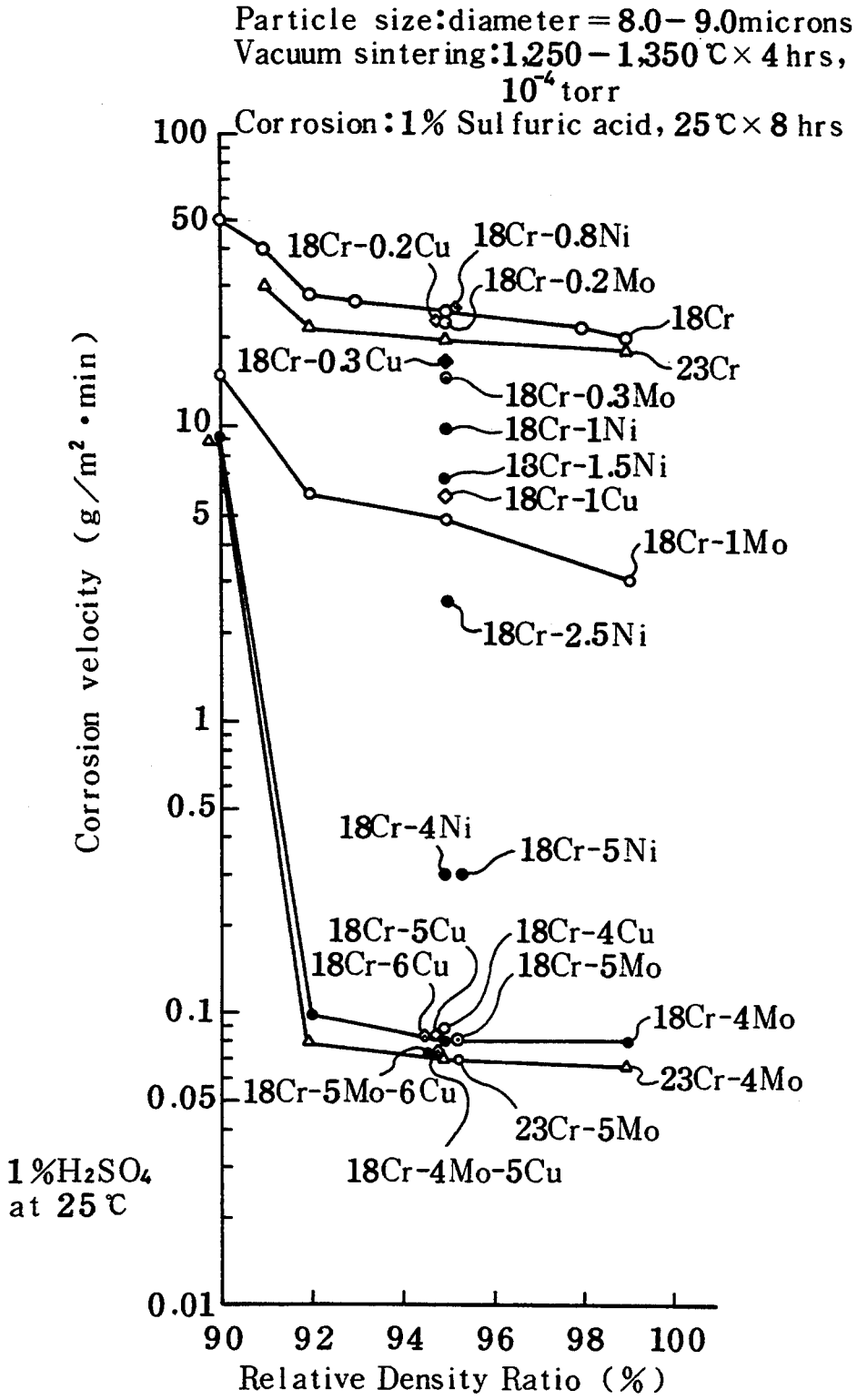
FIG. 5 is a graph which shows a relationship between the relative sintered density ratio of Ferrite-type stainless steel sintered material with which nickel, molybdenum and copper are alloyed and the corrosion velocity in a boiling 1% sulfuric acid solution maintained at 25° C.

The nickel content for improving corrosion resistance of sintered Ferrite-type stainless steel of the present invention is limited to 1.0 to 4.0% by weight, since addition of nickel in an amount exceeding 4.0% by weight does not bring about any improvement in the corrosion resistance, while the corrosion velocity remarkably decreases at the nickel content level of 1.0% by weight or higher, in the case of sintering material constructed with closed pores having the relative density ratio of 95% which is obtained by injection molding stainless steel fine powder of an average particle diameter of 8.0 to 9.0 microns (whose composition being 18% by weight of chromium, 0.02% by weight of carbon, 0.70% by weight of silicon, 1.00% by weight of manganese, 0.02% by weight of phosphorus, and 0.01% by weight of sulfur, the balance being substantially iron) and vacuum sintering the said injection molded material in vacuum at 1,350° C. for 4 hours at $10^{-4}$ torr, according to the corrosion resistance test carried out on samples immersed in a 1% sulfuric solution maintained at 25° C. as shown in FIG. 5, which represents results of elaborate studies made by the present inventors.

The reasons for limiting the nickel content of Austenite-type stainless steel to 8.0 to 22.0% by weight are set forth below. Nickel is a basic alloy element of Austenite-type stainless steel, which expands the gamma-phase area, thus stabilizing Austenite. Nickel is electrochemically noble, compared with iron and chromium, imparts corrosion resistance against chlorides or nonoxidative acids, and intensified the tendency of the passive state of oxides of chromium.

The nickel content is limited to 8.0 to 22.0% by weight, since the sintered steel containing 8.0% by weight of chromium of the present invention is made into Austenite to have sufficient corrosion resistance against chlorides or nonoxidative acids with the nickel content of 8.0% by weight and for a 30.0% by weight chromium-containing steel, the required nickel content is 22.0% by weight and addition of nickel in an amount exceeding 22.0% by weight does not bring about any improvement in the corrosion resistance of Austenite-type sintered stainless steel of the present invention.

The reasons for limiting the molybdenum content and the copper content to 0.3 to 4.0% by weight and 0.5 to 5.0% by weight, respectively, are set forth below. Molybdenum and copper stabilize the passive state of Ferrite-type sintered stainless steel and Austenite-type sintered stainless steel and improve their corrosion resistance.

Figure 7:
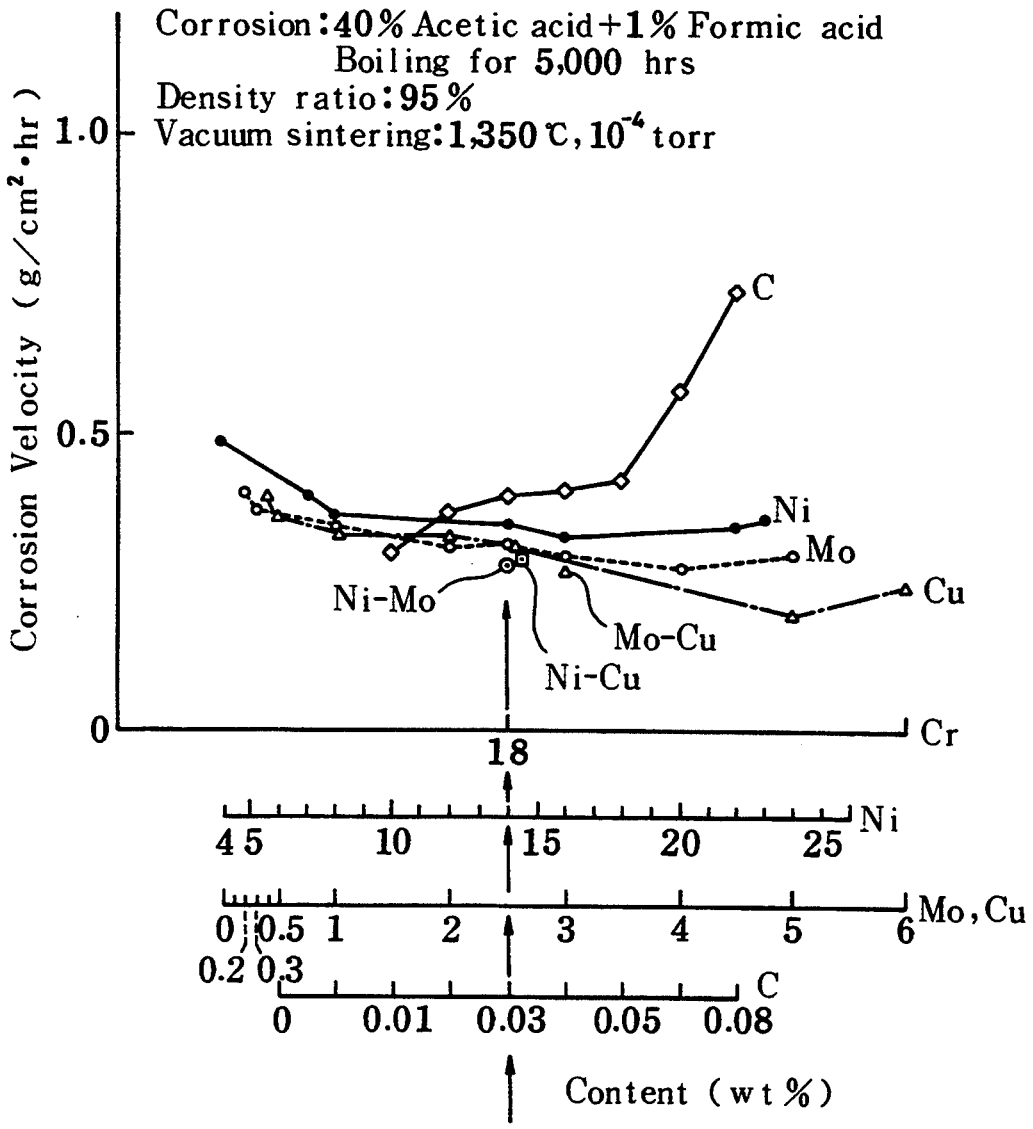
FIG. 7 is a graph which shows a relationship between each of the nickel, molybdenum, copper, and C (as alloy) contents of Austenite-type stainless steel sintered material and the corrosion velocity in a boiling mixture of 40% acetic acid and 1% formic acid solutions.

The molybdenum content and-the copper content are limited to 0.3 to 4.0% by weight and 0.5 to 5.0% by weight, respectively, since addition of molybdenum in an amount exceeding 4.0% by weight or addition of copper in an amount exceeding 5.0% by weight does not bring about any improvement in the corrosion resistance, while the corrosion velocity decreases at the molybdenum content of 0.3% or more by weight or the copper content of 0.5% or more by weight either singularly or in combination, in the case of sintering a material constructed with close pores and having a relative density ratio of 95% which is obtained by injection molding Austenite-type stainless steel fine powder of an average particle diameter of 8.0 to 9.0 microns (18% by weight of chromium, 14% by weight of nickel, 2.5% by weight of molybdenum, 0.70% by weight of silicon, 1.00% by weight of manganese, 0.02% by weight of phosphorus, and 0.01% by weight of sulfur, the balance being substantially iron) and vacuum sintering the said injection molded material in vacuum at 1,350° C. for 4 hours at $10^{-4}$ torr, according to the corrosion resistance test carried out on samples immersed in a boiling mixture of 40% acetic acid and 1% formic acid solution as shown in FIG. 5 and FIG. 7, which represents results of elaborate studies made by the present investors.

The reasons for limiting the tin content, the sulfur content, the selenium content and the tellurium content, 0.05 to 2.00% by weight, 0.02 to 0.50% by weight, 0.05 to 0.20% by weight, and 0.05 to 0.20% by weight, respectively, are set forth below.

Tin, sulfur, selenium, and tellurium improve the cutting efficiency of Ferrite-type sintered steel or Austenite-type sintered steel, when one or more of them are added to it.

Figure 8:
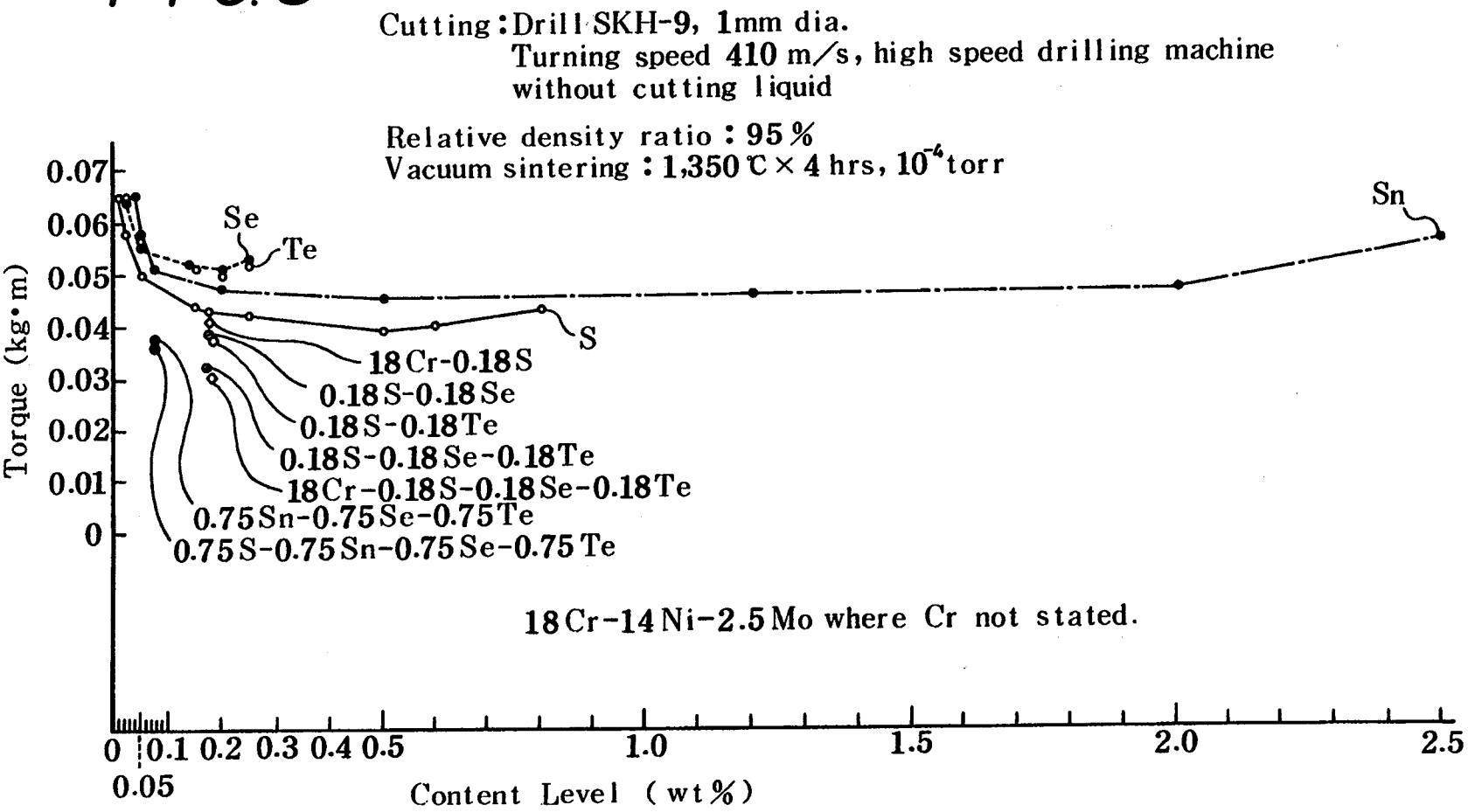
FIG. 8 is a graph which shows a relationship between each of the tin, sulfur, selenium, and tellurium (as alloy) content of each of Ferrite-type stainless Steel sintered material and Austenite-type stainless steel sintered material and the drilling torque.

The tin content, the sulfur content, the selenium content and tellurium content are limited to 0.05 to 2.00% by weight, 0.02 to 0.50% by weight, 0.05 to 0.20% by weight, and 0.05 to 0.20% by weight, respectively, since addition of tin in an amount exceeding 2.00% by weight, addition of sulfur in an amount exceeding 0.50% by weight, addition of selenium in an amount exceeding 0.20% by weight or addition of tellurium in an amount exceeding 0.20% by weight does not bring about any improvement in the cutting efficiency, while the cutting load (torque) decreases at the tin content of 0.05% or more by weight, the sulfur content of 0.02% or more by weight, the selenium content of 0.05% or more by weight, or the tellurium content of 0.05% or more by weight either singularly or in any combination, in the case of sintering a material constructed with closed pores having a relative density ratio of 95% which is obtained by injection molding Ferrite-type stainless steel powder (comprising 0.70% by weight of silicon, 1.00% by weight of manganese, and 18% by weight of chromium) and Austenite-type stainless steel powder (comprising 0.70% by weight of silicon, 1.00% by weight of manganese, 18% by weight of chromium, and 14% by weight of nickel), each of which having an average particle diameter of 8.0 to 9.0 microns and vacuum sintering the said injection molded material in vacuum at 1,350° C. for 1 hour at $10^{-4}$ torr, according to the cutting efficiency test carried out as shown in FIG. 8, which represents results of elaborate studies made by the present inventors.

The reasons for limiting the average particle diameter to 20 microns or less are set forth below. As Table 6 indicates, the density and the corrosion resistance of the final sintered material produced from the said stainless steel fine powder are strongly influenced by the average particle diameter of the said stainless steel powders.

Figure 3:
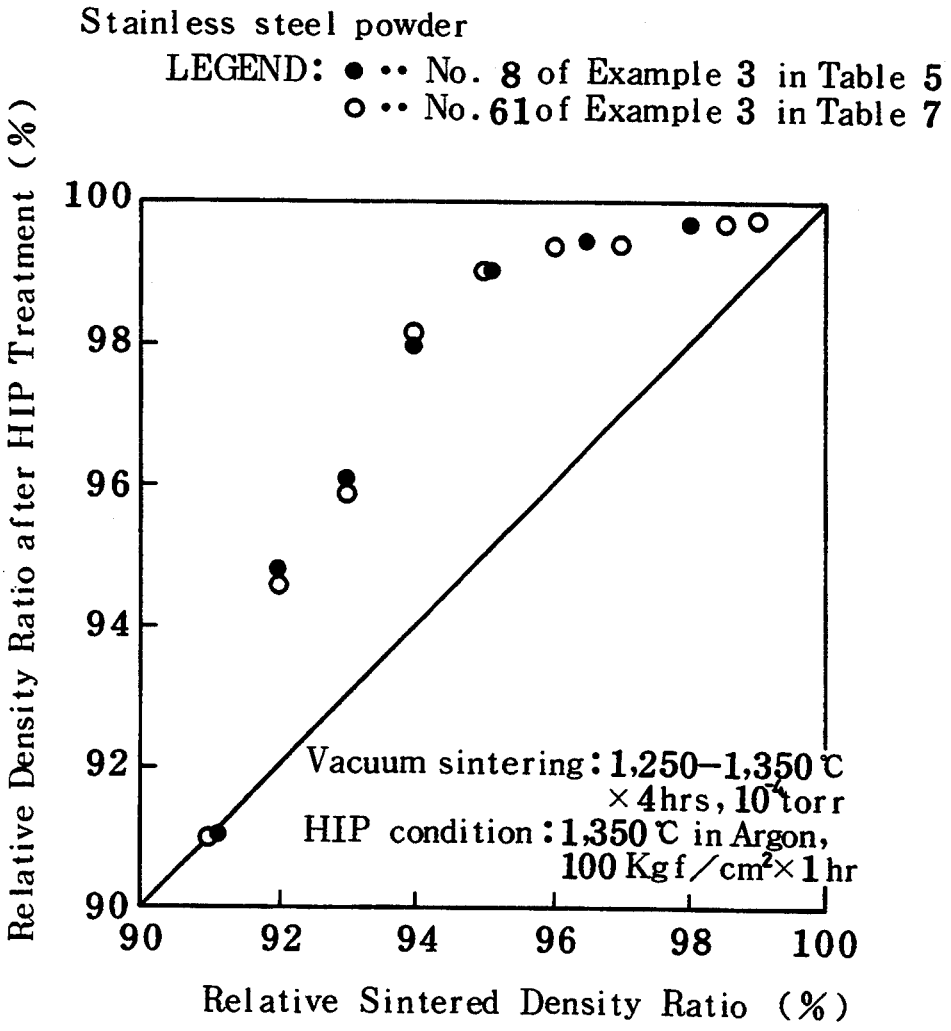
FIG. 3 is a graph which shows a relationship between the relative density ratio of sintered material and the relative density ratio after HIP (hot isostatic press) treatment.
Figure 6:
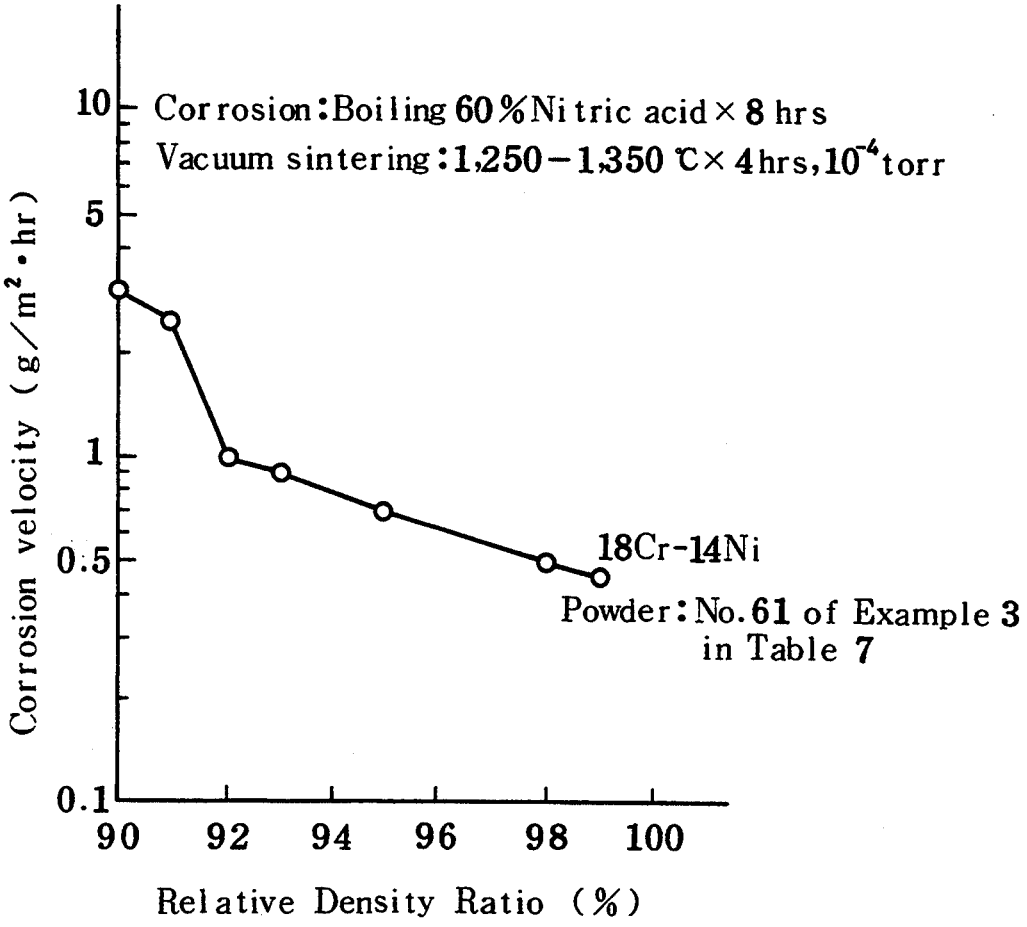
FIG. 6 is a graph which shows a relationship between the relative sintered density ratio of Austenite-type stainless steel sintered material and the corrosion velocity in a boiling 60% nitric acid solution.

The average particle diameter is limited to 20 microns or less, since if the average particle diameter exceeds 20 microns, it becomes impossible to manufacture the sintered material constructed with closed pores which has a relative sintered density ratio of 92% or higher as shown in FIG. 3 and the relative sintered density ratio falls short of 92%, thus causing remarkable deterioration of the corrosion resistance as shown in FIG. 5 and FIG. 6.

(3) Iron-Cobalt alloy powder

Iron-Cobalt alloy powder utilized in the manufacture of sintered iron-cobalt alloy material by injection molding of the present invention comprises 2.0% or less by weight of manganese and 15 to 60% by weight of cobalt, the balance being substantially iron except impurities and has an average particle diameter of 20 microns or less.

Furthermore, the above-mentioned composition may include either one of 0.02 to 1.00% by weight of boron and 0.05 to 1.00% by weight of phosphorus.

More preferably, the composition may be 1.0% or less by weight of carbon, 1.0% or less by weight of silicon, 2.0% or less by weight of manganese, 1.0 or higher Manganese/Silicon ratio, and 15 to 60% by weight of cobalt, the balance being substantially iron except impurities, and has an average particle diameter of 20 microns or less.

(a) Moreover, the above-mentioned composition may contain 1.0 to 4.0% by weight of vanadium.

(b) Or, the above-mentioned composition may contain at least either one of 0.02 to 1.00% by weight of boron and 0.05 to 1.00% by weight of phosphorus. It may contain 1.0 to 4.0% by weight of vanadium additionally.

The reasons for limiting the manganese content to 2.00% or less by weight are set forth below. The manganese content is limited to 2.00% or less by weight, since the saturated magnetic flux density of the sintered material declines to a level lower than that of Fe-single constituent sintered material at a manganese content level higher than 2.00% by weight, although Iron-Cobalt-type melt or Iron-Cobalt-Vanadium-type melt with an increased manganese content produces low melting point MnO-FeO on the surface of the particle at the atomizing stage, which lowers the melting point in the surface layer of the particle before it solidifies and enhances the spherical particle formation of the atomized particle as a result of increase in the surface tension and drop in the viscosity.

The reasons for limiting the carbon content to 1.00% or less by weight are set forth below. Generally, in the case of Iron-Cobalt-type or Iron-Cobalt-Vanadium-type high saturation magnetic flux density sintered material, it is necessary to reduce the carbon content to the bear minimum from the view point of ensuring an acceptable magnetic characteristics.

In particular, raw material powders which are offered to the manufacture of Iron-Cobalt or Iron-Cobalt-Vanadium sintered material by compression molding are required to have its carbon content reduced to an extent lower than that of ingot steel, from the view point of ensuring compressibility in the compression molding as well as of magnetic characteristics.

On the other hand, it was found that in the manufacture of Iron-Cobalt-type or Iron-Cobalt-Vanadium-type sintered stainless steel, use of low carbon raw material does not lead to improved injection moldability and does not offer any merit with respect to corrosion resistance due to contamination with carbon which is produced from organic binder at the debinding stage. Moreover, it was found that the carbon resulting from raw material powder as well as the carbon resulting from the organic binder can be removed by performing sintering in vacuum.

Thus, an attempt was made to improve powder properties of the powder by increasing the carbon content of the powder, rather than reducing the same. As a result, it was found through the experiments that addition of the carbon content improves the compactness of atomized powder for which high pressure medium is utilized (for formation of the spherical particle shape).

It is inferred that the atomized particle is shaped into the spherical shape by dint of the decline in the oxygen content of the melt which is caused by the carbon's getting alloyed with constituents of stainless steel in the melt form and also the decline in the viscosity and melting point of the melt. For example, it is learned that in stainless steel powder obtained by atomizing the melt with circular water jet injected at a 1,000 Kgf/cm$^2$ water pressure having an average particle diameter of 9.0 to 10.0 microns as shown in Table 8, its apparent density and tap density are recognized to increase in accordance with the increase in the alloyed carbon content, hence the spherical particle formation has taken place in the powder.

Furthermore, even in the case of compounds having equivalent powder-to-binder ratio, it is recognized that the viscosity temperature of the compound declines in consequence of the increase in the alloyed carbon content of a 50% iron-containing cobalt fine powder.

However, the viscosity temperature of the compound increases remarkably, if the alloyed carbon content of 50% iron-containing cobalt powder exceeds the level of 1.00% by weight, since the limit of deoxidation owing to the carbon-with-oxygen reaction is lowered to below the limit of deoxidation corresponding to amounts of silicon and manganese alloyed in the melt whose amounts are limited in the melt, thus causing the apparent density and tap density to drop on the contrary, due to production of bubble-like particles in which carbon monoxide gas is encapsulated.

Moreover, the alloyed carbon content of Iron-Cobalt-type alloy powder or Iron-Cobalt-Vanadium-type alloy powder is limited to 1.00% or less by weight, since in case the said compound undergoes vacuum sintering and the maximum sintering time which are ordinarily adopted industrially, namely, for 4 hours, the carbon content of the sintered material cannot be reduced to 0.02% or less by weight, and, consequently, the magnetic characteristics are deteriorated.

The reasons for limiting the silicon content, the manganese content, the Manganese/Silicon ratio to 1.0% or less by weight, 2.00% or less by weight, and 1.00 or higher, respectively, are set forth below. The silicon content and the manganese are limited to 1.00% or less by weight and 2.00% or less by weight, respectively, which correspond to the limits within which the saturated magnetic flux density of Iron-Cobalt-type or Iron-Cobalt-Vanadium-type sintered material is higher than that of sintered single constituent-iron material.

For instance, it is learned that in the case of the said alloy powder obtained by atomizing the melt with water jet as shown in Table 8, its apparent density and tap density are recognized to increase and the viscosity temperature to decrease when the Manganese/Silicon ratio is 1.00 or higher, hence the spherical particle formation is known to have taken place in the powder.

Furthermore, in cases where the Manganese/Silicon ratio is 1.00 or higher, it is recognized that the singered density has increased and the surface condition of the particle has become fair. Therefore, the Manganese/-Silicon ratio is limited to 1.00 or higher.

It is inferred that if the manganese content of the melt increases, MnO, which has a low melting point, is produced on the surface of the particle in the atomizing stage, the melting point of the particle's surface layer drops before the particle solidifies, thus increasing the surface tension and lowering the viscosity of the atomized particle, whereby causing spherical particle formation.

The MnO is considered to be reduced into carbon monoxide by the carbon content of the compound or the alloyed carbon content of the melt, thus not obstructing sintering, so long as the said compound undergoes vacuum sintering at about 1,400° C.

On the contrary, silicon produces viscous silicon dioxide ($SiO_2$) on the surface of the particle in the atomizing stage to make the particle shape irregular, and the silicon dioxide can hardly undergoes reduction into carbon monoxide with carbon in vacuum at a temperature of about 1,400° C., hence sintering is obstructed. Therefore, the Manganese/Silicon ratio is limited to 1.00 or higher for the purpose of achieving spherical particle formation and a surface of the particle which imparts a fair sinterability in the atomizing stage.

The reasons for limiting the cobalt content to 15 to 60% by weight are set forth below. As is the case with ingot steel, cobalt imparts an effect of increasing the saturated magnetic flux density ($B_s$) by means of replacing iron. However, the cobalt content is limited to 15 to 60% by weight, since the said effect is meager if the cobalt content is less than 15% by weight or in excess of 60% by weight.

While the Iron-Cobalt-type alloy powder consists of the above-mentioned specified composition, the effect can be further enhanced by means of adding the following constituents.

The reasons for limiting the vanadium content to 1.0 to 4.0% by weight are set forth below.

As is the case with ingot steel, vanadium imparts an effect of increasing the specific resistance of the sintered material. However, the vanadium content is limited to 1.0 to 4.0% by weight, since the said effect is small if the vanadium content is less than 1.0% by weight and the coercive force ($H_c$) sharply increases, deteriorating the soft magnetism of the material if the vanadium content exceed 4.0% by weight.

Although the melt alloyed with vanadium causes clogging of the tundish nozzle with vanadium oxide ($V_2O_3$) which precipitates on the tundish nozzle due to drop of the melt temperature, it is possible to adjust the oxygen content of the melt to below the V-O deoxidation limit, which reaches the equilibrium at the melt temperature when the melt passes through the tundish nozzle, and thus the nozzle clogging can be avoided.

In this sense, it is beneficial from the economical standpoint for the manufacture of alloy powder by atomizing to get carbon, silicon and manganese alloyed with the melt either singularly or in any combination at the content levels of 1.00% or less by weight for carbon, 1.00% or less by weight for silicon, and 2.00% or less by weight for manganese.

More excellent Iron-Cobalt-type alloy powder can be obtained by adding the following constituents.

The reasons for limiting the boron content and the phosphorus content to 0.02 to 1.00% by weight and 0.05 to 1.00% by weight, respectively, are set forth below.

Although boron and phosphorus impart an effect of producing atomized particles having the spherical particle shape when they are added to the melt to get alloyed with constituents therein either singularly or in combination, the said effect is small if the boron content is less than 0.02% by weight and if the phosphorus content is less than 0.05% by weight and magnetic characteristics, in particular, the maximum magnetic permeability ($\mu_{max}$) and the coercive force ($H_c$) of the sintered material are deteriorated. Therefore, the boron content and the phosphorus content are limited to 0.02 to 1.00% by weight and 0.05 to 1.00% by weight, respectively.

It can be inferred that the spherical particle formation effect which is imparted by the alloying of boron and phosphorus with the melt at the atomizing stage is attributed, as was the case with manganese, to the drop in the melting point and the decrease in the surface viscosity caused by boron oxide and phosphorus oxide produced in the surface of the particle, the increase in the sintered density is attributed to the diffusion promoting effect due to alloying of boron and phosphorus with the melt, and the presence of excessive amounts of boron oxide and phosphorus oxide on the surface of the particle obstruct sintering.

The reason for limiting the average particle size to 20 microns or less are set forth below. As Table 8 indicates, the density and the magnetic characteristics of the final sintered material produced from the said alloy powders are strongly influenced by the average particle diameter of the said alloy powders.

The average particle diameter is limited to 20 microns or less, since the sintered material constructed with closed pores which has a relative sintered density ratio of 92% or higher cannot be produced and remarkable deterioration in magnetic characteristics (the maxim saturation magnetic flux density, maximum magnetic permeability, and the coercive force) result if the average particle diameter exceeds 20 microns.

(B) Injection molding compounds (1) Compounds prepared from stainless steel powder The compounds of the present invention comprises stainless steel powders which have the carbon content of 0.1 to 1.0% by weight and an average particle diameter of 20 microns or less and binder, and have excellent injection moldability.

For the binder as applied to uses in the present invention, organic binders whose principal constituents are thermoplastics, or waxes, or mixtures thereof, and may be added with plasticizer, lubricant, debinding promoting agents, and/or inorganic binders, as the case may require.

As the thermoplastics, one or more kinds may be chosen from among acrylic, polyethylene, polypropylene, and polystyrene.

As the waxes, one or more kinds may be chosen from among natural waxes, which are typically beewax, Japan wax, and montan wax, and synthetic waxes, which are typically low-molecular weight polyethylene, microcrystalline wax, and paraffin wax.

The plasticizer may be selected on the basis of combination with such waxes or waxes which constitute the substantial part, and di-2-ethylhexyl phthalate (DOP), diethyl phthalate (DEP), di-n-butyl phthalate (DHP), and the like may be used.

As the lubricants, higher fatty acids, fatty acid amide, fatty acid esters, and the like may be used, and, depending on the need, waxes may be used as substitute lubricants.

As the debinding promoting agents, subliming substances such as camphor may be added.

Although there is settled no specific limit to the ratio of stainless steel powder to a binder, the binder content of 40 to 50% by volume to the total volume of the compound is preferable.

A batch-type kneader or a continuous-type kneader may be used to mix and knead the metallic powder and the binder. A pressurized kneader, a Banbury mixer, and the like favorably suit for the batch kneader. A twin-screw extruder, and the like favorably suit for the continuous kneader.

The compound for injection molding of the present invention is obtained by pelletizing the kneaded material by a pelletizer or a crusher (grinder).

(2) Compounds prepared from silicon-containing alloy powder

The compounds of the present invention comprises alloy steel powder and a binder which have been described hereinabove in detail, and have excellent injection moldability.

As for specifics of the kind of binder to be used, the amount of the binder, and the method of injection molding, those set forth in the preceding Item (1) apply to this Item (2).

(3) Compounds prepared from Iron-Cobalt alloy powder

The compounds of the present invention comprises iron-cobalt alloy steel powder and a binder which have been described hereinabove in detail, and have excellent injection moldability.

As for specifics of the kind of binder to be used, the amount of the binder, and the method of injection molding, those set forth in the preceding Item (1) apply to this Item (3).

(C) Sintered materials obtained by sintering metallic powder of the present invention The high-density sintered stainless steel of the present invention obtained by sintering the stainless steel powder as set forth in (A)-(1) and (A)-(2) hereinabove has the carbon content of 0.05% or less by weight and the bulk density ratio to true density (the relative sintered density ratio) of 92% or higher.

The reasons for limiting the carbon content of the sintered material to 0.05% or less by weight are set forth below.

Influences of trace carbon, which is an impurity, upon the corrosion resistance can be clarified by a corrosion test using organic acids.

The corrosion velocity of the sample immersed in a boiling mixture of 40% acetic acid and 1% formic acid solutions as shown in FIG. 7 which represents results of elaborate studies made by the present inventors remarkably increases when the carbon content exceeds 0.05% by weight. Therefore, the carbon content of the sintered stainless steel of the present invention is limited to 0.05% by weight.

The reasons for limiting the relative sintered density ratio to 92% or higher are set forth below.

The relative sintered density ratio is an important property value which has an immense influence upon the corrosion resistance of the sintered material.

As FIGS. 5 and 6 show, the corrosion resistance increases remarkably when the relative sintered density ratio is 92% or higher even in the case of Ferrite-type and Austenite-type.

That is due to the construction of the particle with closed pores, as can be learned from the increase in the HIP (hot isostatic press) density which is caused when the relative sintered density ratio is 92% or higher, as shown by FIG. 3. Therefore, the relative sintered density ratio of the sintered stainless steel of the present invention is limited to 92% or higher.

The stainless steel material of the present invention can be manufactured in the following manner.

The stainless steel powder of the present invention and an adequate organic binder are kneaded by a pressurized kneader or the like, and a compound is thus prepared, and such compound is injection molded by an injection molding apparatus so that the injection molded part of a desired configuration may be obtained. The obtained injection molded part is subjected to a debinding treatment at a temperature between 200° C. and 600° C. to obtain a debound part.

While the debinding treatment may be carried out in any atmosphere, so long as the atmosphere does not alter the shape of the injection molded part, or causes the shape of the injection molded part uninformly, even if it is altered, it is preferable that, for instance, the debinding treatment is carried out in a nonoxidating atmosphere or a reduced pressure atmosphere.

The sintered stainless steel material of the present invention can be manufactured by means of sintering the above-mentioned debound part.

The high magnetic flux-density sintered Iron-Cobalt alloy material of the present invention, which is obtained by sintering the Iron-Cobalt alloy powder described in (A)-(3) hereinabove, has the carbon content of 0.02% or less by weight and the bulk density ratio to true density of 92% or higher.

The reasons for limiting the carbon content of the sintered material to 0.02% or less by weight are set forth below. The presence of carbon, which is an impurity, gives an adverse effect on magnetic characteristics, in particular, the maximum magnetic permeability and the coercive force. The carbon content is limited to 0.02% or less by weight, since the maximum magnetic permeability and the coercive force are remarkably deteriorated when the carbon content exceeds 0.02% by weight.

The reasons for limiting the relative sintered density ratio to 92% or higher are set forth below. The relative sintered density ratio is an important property value which influences the saturated magnetic flux density ($B_s$), the maximum magnetic permeability ($\mu_{max}$), and the coercive force ($H_c$) of the sintered material.

The saturated magnetic flux density, the maximum magnetic permeability and the coercive force altogether are remarkably deteriorated when the relative sintered density ratio is less than 92%.

Figure 9:
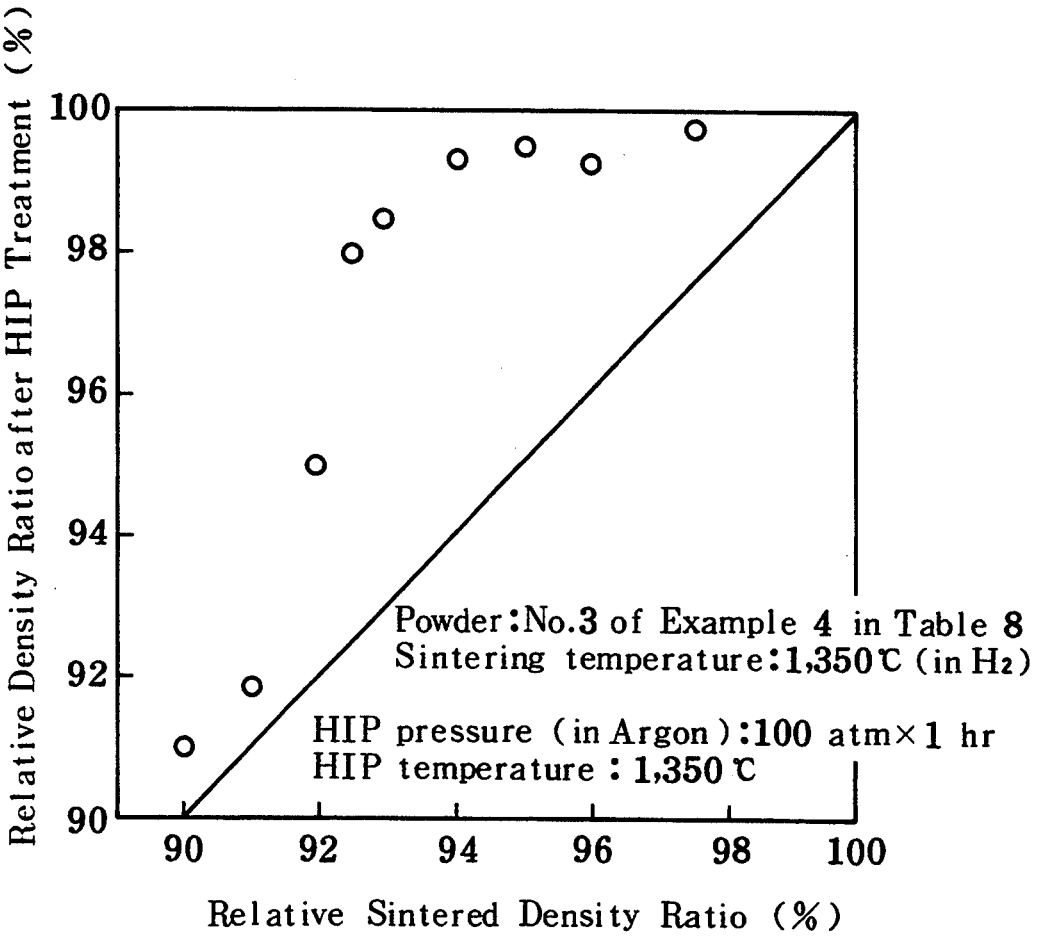
FIG. 9 is a graph which shows a relationship between the relative density ratio of sintered material and the relative density ratio after HIP (hot isostatic press) treatment.

Based on the finding that the density does not increase with the relative sintered density ratio being less than 92% according to experiments relating to increases in the density by HIP as shown in FIG. 9, the above-mentioned tendency is attributed to the construction of the particle with closed pores in it. Therefore, the relative sintered density ratio is limited to 92% or higher, since the sintered material is constructed with closed pores.

(D) The method of manufacturing sintered material

The above-mentioned sintered material of the present invention is obtained preferably by the method as set forth below.

A compound is obtained by mixing alloy steel powder, stainless steel powder, or Iron-Cobalt alloy steel powder with a binder, the obtained compound is injection molded, and then the obtained injection molded part is sintered after it is dewaxed.

In the above-mentioned steps, at least the first-stage of the sintering step, is carried out in a reduced pressure atmosphere.

The injection molding is carried out ordinarily by an injection molding apparatus designed to handle plastics. However, provisions against contamination or for extension of the machine life can be made, depending on the need, by carrying out an anti-abrasion treatment of the internal surface of the machine with which the raw material comes in contact.

The obtained injection molded part is subjected to a debinding treatment in open atmosphere or neutral or reducing gas atmosphere.

In the steps of injection molding the compound for the injection molding use, debinding the injection molded part and sintering the debound part, it is necessary that at least the first-stage of the sintering step is carried out in a reduced pressure atmosphere.

Here "the first-stage of the sintering step" means the process prior to which the density ratio of the sintered material reaches about 90%.

The reason for that is that when the density ratio of the sintered material exceeds 90%, a great majority of pores in the sintered material become closed pores and it becomes difficult to remove from within the pores in the sintered material the carbon monoxide gas generated by reduction and decarbonizing reaction which occur in a reduced pressure atmosphere mentioned later, and thus the said reaction is kept from progressing efficiently.

As for the atmosphere in which the sintering is carried out, the atmosphere is to be capable to enabling reduction of oxides of chromium, etc., which obstruct diffusion of atoms during the sintering step, and also capable of removing carbon contained in a large quantity in the debound parts after the debinding treatment.

Hydrogen and a reduced pressure atmosphere are cited as those meeting the above-mentioned requisite conditions, as is the case with the manufacture of the ordinary sintered stainless steel material.

Nevertheless, since the reduction and decarbonization in a hydrogen atmosphere progress according to the following equations, respectively:

$$MO+H_2 \rightarrow M+H_2O \text{ (M: Metal)} \qquad \text{Reduction}$$

$$C+H_2O \rightarrow CO+H_2 \text{ (C: Solid solution carbon)} \qquad \text{Decarbonization}$$

The lower is $PH_2O/PH_2$, the faster progresses the reaction.

The higher is $PH_2O/PH_2$, the faster progresses the decarbonization.

Therefore, it is difficult to cause both reactions progress efficiently simultaneously. Particularly, in case of stainless steel, for instance, which contains chromium oxides which are hardly reducible and the debound material contains a high carbon value, it is not beneficial to utilize hydrogen atmosphere.

On the other hand, reduction and decarbonization in a reduced pressure atmosphere progress simultaneously as shown by the following equation, and by means of removing carbon monoxide gas as an exhaust gas, the reaction can be caused to progress efficiently.

$$MO+C \rightarrow M+CO \qquad \text{Reduction and decarbonization}$$

Moreover, since the amounts of oxygen and carbon contained in the final sintered material tend to be lower under a reduced pressure, compared with a hydrogen atmosphere, sintering is performed under reduced pressure for the manufacturing method according to the present invention.

For the purpose of causing the reduction and deoxidization to progress efficiently in chromium oxides, the pressure of reduced pressure atmosphere is preferably 0.01 torr or lower, and the temperature range is preferably between 1,100° C. and 1,350° C.

Since a reduced pressure atmosphere is needed only during the stage in which reduction and decarbonization are in progress, in the stages following completion of the said reactions, it is preferable that the atmosphere under reduced pressure be replaced by an nonoxidating atmosphere, such as inert gas (e.g. nitrogen, argon) atmosphere and a low dew point hydrogen atmosphere as a protective atmosphere.

As mentioned above, it is possible to manufacture low-carbon and low-oxygen sintered stainless steel material having excellent corrosion resistance efficiently by means of performing sintering under reduced pressure.

EXAMPLES

Examples of the present invention are given below by way of illustration, and not by way of limitation.

EXAMPLE 1 AND COMPARATIVE EXAMPLE 1

Stainless steel powders added with carbon and comprising the composition as shown in Table 1 was prepared by an atomizing method using water. Results of studies made on powder characteristics of those steel powders are shown in Table 2.

TABLE 1

| | No. | Chemical composition (%) C | Si | Mn | P | S | Ni | Cr | Mo | Remarks |
|---|---|---|---|---|---|---|---|---|---|---|
| Example 1 | 1 | 0.11 | 0.89 | 0.18 | 0.02 | 0.01 | 14.1 | 17.8 | 2.5 | Corre- |
| | 2 | 0.25 | 0.85 | 0.20 | 0.02 | 0.01 | 14.2 | 18.0 | 2.5 | sponds to |
| | 3 | 0.50 | 0.84 | 0.19 | 0.02 | 0.01 | 14.1 | 17.8 | 2.4 | SUS316, |
| | 4 | 0.93 | 0.89 | 0.16 | 0.02 | 0.01 | 13.9 | 17.9 | 2.4 | JIS |
| Comparative | 5 | 1.20 | 0.87 | 0.19 | 0.02 | 0.01 | 14.0 | 17.8 | 2.4 | |
| Example 1 | 6 | 0.02 | 0.86 | 0.18 | 0.02 | 0.01 | 14.1 | 17.9 | 2.5 | |

It is obviously learned from Table 2 that the steel powders No. 1 through No. 4 prepared according to the present invention have their tap density and bulk density increased, have their specific surface area decreased, and have their particles shaped into the spherical form, despite that all of the powders are generally mutually equivalent with respect to the average particle diameter and the particle size distribution.

While the above-mentioned powder characteristics represent an indirect evaluation of the injection moldability, results of direct evaluation of such compounds that were actually obtained by kneading the steel powders with an organic binder added by 46% by volume are set forth additionally in Table 2.

The said evaluation shows a temperature levels at which a certain prescribed viscosity is learned to have been reached by measuring the viscosity of compounds prepared by adding to each samples of steel powder an equal amount of wax-type binder and kneading them together. The lower is the temperature, the lower becomes the viscosity. Through the above-mentioned evaluation of compounds, it was found that the steel powder No. 1 through No. 4 which were prepared according to the present invention exhibit effective declines in the viscosity of the compound, alike the changes in the powder characteristics, whereby it is verified that the stainless steel powders of the present invention excel in the injection moldability.

Furthermore, a smaller quantity of the organic binder than that of the steel powder in Comparative Examples 5 and 6 was sufficient to obtain a compound having the equal viscosity level as that in the same Comparative Examples.

The compound used as the sample for viscosity measurement was injection molded into specimens of 40 mm width, 20 mm length and 2 mm thickness at 145° C. injection nozzle temperature and 30° C. mold temperature. The injection molded part was subjected to a debinding treatment in which it was left to stand for 1 hour after having been heated to 600° C. from room temperature at a rate of 10° C. rise per hour.

The debound part was sintered at 1,300° C. for 4 hours under 0.0001 torr reduced pressure.

The carbon content of the sintered part is additionally shown in Table 2. In the case where the steel powder of the present invention were used, the carbon content could be reduced to its bare minimum. However, in the case where the reference steel powder No. 5 containing 1.2% carbon could not have its carbon content reduced sufficiently in its sintered form.

EXAMPLE 2 AND COMPARATIVE EXAMPLE 2

The stainless steel powders having the composition as shown in Table 3 were prepared by the water atomizing method.

Results of studies on powder characteristics of those steel powders are summed up in Table 4. Next, results of studies on sintered parts which were prepared under the same conditions, except for the sintering condition, in Example 1 are shown in Table 4. The sintering was performed in two steps, firstly for 2 hours at 1,135° C. under reduced pressure of 0.0001 torr, and secondly immediately following the first step, for another 2 hours at 1,350° C. in argon gas atmosphere maintained at 1.02 atm, with argon gas introduced into the same space.

It is learned from Table 3 and Table 4 that the steel powders of the present invention excel in the injection moldability and give sintered parts whose characteristics are comparable with the conventional products over an extensive composition range of stainless steel.

According to the present invention, stainless steel powders having the spherical particle shape which are suitable for injection molding are provided, production of sintered stainless steel parts of complex configurations are readily realized, whereby the scope of application of sintered stainless steel can be enlarged.

EXAMPLE 3 AND COMPARATIVE EXAMPLE 3

Presented in Table 5 through Table 7 are examples of the present invention, along with a Comparative Example, for the sintered material prepared by sintering Ferrite-type stainless steel powder, Austenite-type stainless steel powder, and the stainless steel powder of the present invention for high-density sintering use obtained by the water atomizing method.

Ferrite-type stainless steel alloy powder and Austenite-type stainless steel powder having their respective chemical compositions were prepared by perpendicularly dripping through an orifice nozzle constructed of a refractory material provided on the bottom of a tundish the melt of ingot Ferrite-type stainless steel alloy and Austenite-type stainless steel alloy manufactured by a high frequency induction furnace, and atomizing the dripped melt by applying a conical water jet of 1,000 Kgf/cm$^2$ pressure encircling the axis of the drip and narrowing in the downward direction.

The obtained stainless steel alloy powder was analyzed on a Microtrack grading analyzer for the average particle diameter (the particle diameter of the particle size group with whose addition the cumulative volume measured from the finer particle size group reaches the 50% level of the total volume), the apparent density and the tap density.

Next, the viscosity temperature (the temperature at which the viscosity reaches 100 poise) was measured by extruding through a die of 1 mm diameter and 1 mm length under a 10 kg load provided on a flow tester a compound prepared by kneading by a pressurized kneader each one of those alloy powders with wax-type organic binders, the blending ratio of the latter being 46% by volume.

The same compound as used as the sample for viscosity measurement was injection molded into specimens of 40 mm width, 20 mm length and 2 mm thickness at 145° C. injection nozzle temperature and 30° C. mold temperature. The injection molded part was subjected to a dewaxing treatment in which it was left to stand for 1 hour after having been heated to 600° C. from room temperature at a rate of 10° C. rise per hour.

The dewaxed part was sintered at 1,300° C. for 4 hours under 0.0001 torr pressure.

The obtained sintered part was measured for the specific gravity by means of weighing samples submerged in water, and the relative sintered density ratios were calculated.

Other sintered materials prepared under the same conditions were analyzed for their carbon contents. Using other sintered materials as samples, experiments were carried out to determine increases in the density by HIP treatment as shown in FIG. 3, and corrosion tests as shown in FIG. 4 through FIG. 7 were carried out to determine the corrosion resistance. Furthermore, cutting tests were carried out on other sintered materials as shown in FIG. 8.

As are obvious from No. 1 through No. 19 of Example 3 in Table 5 and No.55 through No. 69 of Example 3 in Table 7, according as the Manganese/Silicon ratio increased, the apparent density and the tap density registered high values, and the viscosity of the compound registered low values (the lower is the temperature, the lower becomes the viscosity), in the case of Ferrite-type stainless steel powder which has an average particle diameter of 20 microns or less and a chromium content of 8.0 to 30.0% by weight, provided that it either does not contain a substantial amount of carbon (0.01 to 0.02% by weight of carbon) or, in case it contains carbon, has a composition of 1.20% by weight of carbon, 0.20% or more by weight of silicon and 1.00 or higher Manganese/Silicon ratio, and in the case of Austenite-type stainless steel powder which has an average particle diameter of 20 microns or less and has a composition of 8.0 to 30.0% by weight of chromium and 8.0 to 22.0% by weight of nickel. Thus, it is known that spherical particle formation has occurred in the powder and it has acquired excellent injection moldability. Sintered material which has the carbon content of 0.05% or less by weight and a relative sintered density ratio of 92% or more was obtained.

As are obvious from No. 20 through No. 38 of Example 3 in Table 5, No. 50 through No. 54 of Example 3 in Table 6, and No. 70 through No. 88 of Example 3 in Table 7, the stainless steel powders of the present invention which contain nickel, molybdenum, copper, tin, sulfur, selenium and tellurium singularly or in any combination are atomized powders which are in the spherical particle form and exhibit excellent injection moldability and gave sintered material whose carbon content as sintered is 0.01% by weight and relative sintered density ratio of 92% or higher.

As are obvious from No. 50 through No. 54 of Example 3 in Table 6, in the case of nickel-containing Ferrite-type stainless steel powder of the present invention having an average particle diameter of 20 micron or less, its apparent density and tap density increase with increases in the average particle diameter and the viscosity of the compound decreases, although its relative sintered density ratio decreases. With an average particle diameter less than 20 microns, sintered material having a relative sintered density ratio of 92% or higher and an excellent corrosion resistance is obtained. The said relationship between the average particle diameter and the relative sintered density ratio also applies to Austenite-type stainless steel powder and sintered material obtained therefrom.

FIG. 3 shows a relationship between the relative density ratio of sintered material, which has undergone an HIP treatment carried out at 1,350° C. for 1 hour in argon atmosphere maintained at 100 Kgf/cm$^2$, and the relative density ratio after the said HIP treatment, which was measured on samples prepared by injection molding compound made from Ferrite-type and Austenite-type stainless steel powders shown in No. 8 through No. 61 of Example 3, which are examples of the present invention, in Table 5 and Table 7, and then sintering the injection molded part at a temperature between 1,250° and 1,350° C. for 4 hours.

As is obviously learned from the FIG. 3, at a relative density ratio of 92% or higher, intercommunicating pores in the sintered material become closed pores and the relative density ratio after the HIP treatment is further improved.

FIG. 4 shows results of a corrosion resistance test performed in a boiling 60% nitric acid solution on sintered materials constructed with closed pores and having a relative density ratio of 95%, which was obtained by injection molding compound prepared from Ferrite-type chromium-containing steel powder which has an average particle diameter of 8.0 to 9.0 microns and has the composition of 5.0 to 33.0% by weight of chromium, 0.02 to 0.70% by weight of silicon, 1.00% by weight of manganese, and 0.01% by weight of sulfur, the balance being substantially iron, and vacuum sintered at $10^{-4}$ torr at 1350° C.

As is obvious from the FIG. 4, the corrosion velocity remarkably decreases at a chromium content level of 8.0% or more, and there is provided no effect of improving the corrosion resistance even if the chromium content exceeds 30.0% by weight.

FIG. 5 shows results of a corrosion resistance test performed in a 1% sulfuric acid solution maintained at 25° C. on sintered material having a relative density ratio of 90% or higher, which was obtained by injection molding compound prepared from Ferrite-type stainless steel powder which has an average particle diameter of 8.0 to 9.0 microns and has the basic alloy composition of 18.23% by weight of chromium, 0.02% by weight of carbon, 0.70% by weight of silicon, 1.00% by weight of manganese, 0.02% by weigh of phosphorus, and 0.01% by weight of sulfur, the balance being substantially iron, added with 0.8 to 5.0% by weight of nickel, 0.2 to 5.0% by weight of molybdenum, and 0.2 to 6.0% by weight of copper either singularly or in any combination, and vacuum sintering the injection molded part at a temperature between 1,250° C. and 1,350° C. for 4 hours at $10^{-4}$ torr.

As is obvious from the FIG. 5, the corrosion velocity decreases remarkably at a relative density ratio of 92% or higher due to the particle construction with closed pores which occur at such levels.

With the relative density ratio being at 95% due to closed pores, the corrosion velocity remarkable deceases at the nickel content of 1.0% or more by weight, the molybdenum content of 0.3% or more by weight, the copper content of 0.5% or more by weight singularly or in any combination, although there is provided no effect of improving the corrosion resistance, even if the nickel content exceeds 4.0% by weight, the molybdenum content exceeds 4.0% by weight, or the copper content exceeds 5.0% by weight.

FIG. 6 shows results of a corrosion resistance test performed with a boiling 60% nitric acid solution on sintered material having a relative density ratio of 90% or higher, which was obtained by injection molding compound made from Austenite-type stainless steel powder listed as No. 61 of Example 3, which is an example of the present invention, in Table 7, and vacuum sintering the injection molded part at a temperature between 1,250° C. and 1,350° C. for 4 hours at $10^{-4}$ torr As is obvious from the FIG. 6 Austenite-type stainless steel has its corrosion velocity remarkably decreased at a relative density ratio of 92% or higher, and the material is constructed with closed pores.

FIG. 7 shows results of a corrosion resistance test performed with a boiling mixture of 40% acetic acid and 1% formic acid on sintered materials have a relative density ratio of 95% which was obtained by injection molding compound made from Austenite-type stainless steel powder which has an average particle diameter of 8.0 to 9.0 microns and has the basic alloy composition of 18% by weight of chromium, 14% by weight of nickel, 2.5% by weight of molybdenum, 0.70% by weight of silicon, 1.00% by weight of manganese, 0.02% by weight of phosphorus, and 0.01% by weight of sulfur, the balance being substantially iron (the carbon content as sintered being 0.03% by weight) added with 4.0 to 25.0% by weight of nickel, 0.3 to 5.0% by weight of molybdenum, 0.4 to 6.0% by weight of copper, and 0.01 to 0.08% by weight of carbon, either singularly or in any combination, and vacuum sintering the injection molded part at 1,350° C. for 4 hours at $10^{-4}$ torr.

As is obvious from the FIG. 7, the corrosion velocity remarkably decreases at a nickel content level of 8.0% or more, the molybdenum content of 0.3% or more by weight, the copper content of 0.5% or more by weight, the carbon content of 0.05% or less by weight either singularly or in any combination, and there is provided no effect of improving the corrosion resistance even if the nickel content exceeds 22.0% by weight, the molybdenum content exceeds 4.0% by weight and the copper content exceeds 5.0% by weight.

FIG. 8 shows results of a dry drilling/cutting test performed with a 1 mm diameter drill constructed of SKH-9 revolving at a revolving velocity of 410 m/s on sintered material, which was obtained by injection molding compound made from Ferrite-type stainless steel powder having an average particle diameter of 8.0 to 9.0 microns and the composition of 0.70% by weight of silicon, 1.00% by weight of manganese, 18% by weight of chromium, and Austenite-type stainless steel powder having an average particle diameter of 8.0 to 9.0 microns and the composition of 0.70% by weight of silicon, 1.00% by weight of manganese, 18% by weight of chromium, and 14% by weight of nickel, both of which constitution the basic alloy composition, added with 0.03 to 2.5% by weight of tin, 0.01 to 0.60% by weight of sulfur, 0.025 to 0.25% by weight selenium, and 0.025 to 0.25% by weight of tellurium, either singularly or in any combination, and vacuum sintering the obtained injection molded part at 1,350° C. for 4 hours at $10^{-4}$ torr.

As is obvious from the FIG. 8, the cutting torque remarkably decreases at the tin content of 0.05% or more by weight, the sulfur content of 0.02% or more by weight, the selenium content of 0.05% or more by weight, the tellurium content of 0.05% or more by weight, either singularly or in any combination, although there is provided no effect of improving the cutting torque even if the tin content exceeds 2.00% by weight, the sulfur content exceeds 0.50% by weight, the selenium content exceeds 0.20% by weight and the tellurium content exceeds 0.20% by weight.

As been described in detail in the foregoing, according to the present invention, there is provided stainless steel powders whose injection moldability and sinterability are improved by achieving spherical particle formation and modifying surface conditions of the particle by means of atomizing the melt whose composition is so adjusted that the carbon content, the silicon content and the Manganese/Silicon ratio will become 1.20% or less by weight, 0.20% or more by weight, and 1.00 or higher, respectively, from its basic melt composition of 8.0 to 30% by weight of chromium and 8.0 to 22.0% by weight of nickel, to obtain fine powder of an average particle diameter of 20 microns or less. Furthermore, there is provided through use of the said stainless steel powder a high-density, high corrosion resistance sintered stainless steel material having a relative density ratio of 92% or higher and the carbon content of 0.05% or less by weight.

According to the present invention, there is provided a stainless steel powder, from which a superior sintered material with remarkable improved corrosion resistance which has a relative density ratio of 92% or higher and a carbon content of 0.05% or less by weight is obtained, and also stainless steel powders for obtaining the said sintered material by atomizing into fine powder of an average particle diameter of 20 microns or less the above-mentioned melt, with which 1.0 to 4.0% by weight of nickel is alloyed in the case of Ferrite-type, and one or both of 0.3 to 4.0% by weight of molybdenum and 0.5 to 5.0% by weight of copper in the case of Ferrite-type or Austenite-type.

Furthermore, according to the present invention, there is provided a stainless steel powder, from which a superior sintered material with remarkable improved cutting characteristics which has a relative density ratio of 92% or higher and a carbon content of 0.05% or less by weight is obtained, and also stainless steel powders for obtaining the said sintered material by atomizing into fine powder of an average particle diameter of 20 microns or less the above-mentioned melt, with which one or more of 0.05 to 2.00% by weight of sulfur, 0.05 to 0.20% by weight of selenium, 0.05 to 0.20% by weight of tellurium is or are alloyed with the said melt in case of Ferrite-type or Austenite-type.

EXAMPLE 4 AND COMPARATIVE EXAMPLE 4

Presented in Table 8 is an example of the present invention, along with a Comparative Example, for high saturation magnetic flux density sintered material prepared by sintering Iron-Cobalt-type alloy powder and Iron-Cobalt-Vanadium-type alloy powder, both of which are for high saturation magnetic flux density sintering use, obtained by the water atomizing method.

Iron-Cobalt-type and Iron-Cobalt-Vanadium-type alloy powder having their respective chemical compositions shown in Table 8 were prepared by perpendicularly dripping through an orifice nozzle constructed of a refractory material provided on the bottom of a tundish the melt of ingot Iron-Cobalt-type and Iron-Cobalt-Vanadium-type steel manufactured by a high frequency induction furnace, and atomizing the dripped melt by applying a conical water jet of 1,000 Kgf/cm$^2$ pressure encircling the axis of the drip and narrowing in the downward direction.

The obtained alloy powder was analyzed on a Microtrack grading analyzer for the average particle diameter (the particle diameter of the particle size group with whose addition the cumulative volume measured from the finer particle size group reaches the 50% level of the total volume), the apparent density and the tap density.

Next, the viscosity temperature (the temperature at which the viscosity reaches 100 poise) was measured by extruding through a die of 1 mm diameter and 1 mm length under a 10 kg load provided on a flow tester a compound prepared by kneading by a pressurized kneader each one of those alloy powders with wax-type organic binders, the blending ratio of the latter being 46% by volume.

Then, the compound was injection molded into rings of 53 mm outer diameter, 41 mm inner diameter, and 4.7 mm height by an injection molding apparatus at an injection molding temperature of 150° C. The injection molded part was subjected to a dewaxing treatment in nitrogen atmosphere in which it was heated up to 600° C. at a rate of 7.5° C. rise per hour and left to stand for 30 minutes.

Following the said dewaxing step, the dewaxed material was sintered in hydrogen atmosphere in which it was heated up to 700° C. at a rate of 5° C. rise per minute and left to stand for 1 hour at 700° C., for another hour at 950° C. and the following 2 hours at 1,350° C. Up to the end of the 950° C. stage, the dew point was controlled to +30° C., and beyond the said end point, the dew point was controlled to −20° C. or lower.

The obtained sintered material was measure for the specific gravity by means of weighing samples submerged in water, and the relative sintered density ratios were calculated.

Moreover, samples prepared under the same conditions had wires wound around them and were measured by a self-registering magnetic flux recorder for magnetic characteristics. Results of the said measurement are shown in Table 8.

As are obvious from No. 1 through No. 18 of Example 4 in Table 8, in the case of Iron-Cobalt-type alloy powder of the present invention having an average particle diameter of 20 micron or less and the cobalt of 10 to 60% by weight whose composition comprises 1.00% or less by weight of carbon, 1.00% or less by weight of silicon, 2.00% or less by weight of manganese, 1.00 or higher Manganese/Silicon ratio, its apparent density and tap density increase with increases in the manganese content, and the Manganese/Silicon ratio and the carbon content.

Moreover, the compound prepared from the above-mentioned powders exhibit low viscosity values (the viscosity decreases with temperature drops), whereby it is learned that spherical particle formation has been achieved in the powders, hence they have excellent injection moldability.

Sintered material which has the carbon content of 0.02% or less by weight and the relative sintered density ratio of 95% was obtained. Hence, sintered material having excellent magnetic characteristics (the saturation magnetic flux density, the maximum magnetic permeability, and the coercive force) can be prepared.

As are obvious from No. 19 through 23 of Example 4 in Table 8, in the case of Iron-Cobalt-Vanadium-type alloy powder of the present invention having the vanadium content of 1.0 to 4.0% by weight, atomized powders which are in the spherical particle form and exhibit excellent injection moldability could be manufactured by increasing the silicon content and the manganese content, and controlling the Manganese/Silicon ratio to 1.00 or higher by way of alloying vanadium with the melt with a view to preventing clogging of the nozzle with the melt.

A sintered material having the carbon content of 0.01% by weight and a relative sintered density ratio of 95% which exhibits excellent magnetic characteristics (Bs, $\mu$max, Hc) can be obtained.

As is obvious from No. 24 through No. 33 of Example 4 in Table 8, in the case of Iron-Cobalt-type and Iron-Cobalt-Vanadium-type alloy powders of the present invention whose composition is 0.02 to 1.0% by weight of boron and 0.05 to 1.00% by weight of phosphorus, the apparent density and the tap density increase by dint of alloying of boron and phosphorus with the melt and the viscosity of the compound prepared therefrom drops, and the spherical particle formation and the injection moldability are further improved, compared with the case in which boron and phosphorus are not added (No. 3 of Example 4). A sintered material which has the carbon content as sintered of 0.01% by weight and has more excellent magnetic characteristics (Bs, $\mu$max, Hc) with a high compactness, i.e., a relative sintered density ratio of 96% can be obtained.

As is obvious from No. 34 through No. 43 of Example 4, in Table 8, in the case of Iron-Cobalt-type alloy powder of the present invention having the average particle diameter of 20 microns or less, the apparent density and tap density of the said alloy powder increase with increases in the average particle diameter, the viscosity of the compound made therefrom decrease with increases in the average particle diameter, although the relative sintered density ratio and, accordingly, magnetic characteristics (Bs, $\mu$max, Hc) decrease with increases in the average particle diameter.

The same tendency applied to Iron-Cobalt-Vanadium-type alloy powder.

Sintered material having excellent magnetic characteristics can be obtained at the average particle diameter level of 20 microns or lower.

FIG. 9 shows a relationship between the relative density ratio of sintered material, which has undergone an HIP treatment carried out at 1,350° C. for 1 hour in argon atmosphere maintained at 100 kgf/cm$^2$, and the relative density ratio after the said HIP treatment, which was measured on samples prepared by injection molding compound made from Iron-Cobalt-type alloy powder shown in No. 3 of Example 4, which is an example of the present invention, in Table 8. As is obviously learned from the FIG. 9, at a relative density ratio of 92% or higher, pores in the sintered material become closed pores and the relative density ratio after the HIP treatment is further improved.

TABLE 2

| | No | Particle Size Distribution *1 $D_{+\sigma}$ (μm) | $D_{50}$ (μm) | $D_{-\sigma}$ (μm) | $D_{+\sigma}/D_{50}$ | $D_{50}/D_{-\sigma}$ | MV (μm) | Tap Density (g/cc) *2 6 min | 10 min | Apparent Density (g/cc) | Specific Surface Area *3 ($m^2/g$) | Viscosity Temperature (°C.) *4 100P | 1000P | 10000P | Carbon Content of Sintered Body (%) |
|---|---|---|---|---|---|---|---|---|---|---|---|---|---|---|---|
| Example 1 | 1 | 18.6 | 10.5 | 5.1 | 1.77 | 2.06 | 12.3 | 3.61 | 3.65 | 2.28 | 0.450 | 139.3 | 121.9 | 105.9 | 0.02 |
| | 2 | 19.1 | 10.6 | 5.4 | 1.80 | 1.96 | 12.4 | 3.68 | 3.73 | 2.36 | 0.436 | 133.2 | 112.5 | 101.3 | 0.01 |
| | 3 | 19.4 | 10.7 | 5.3 | 1.81 | 2.02 | 12.5 | 3.78 | 3.84 | 2.51 | 0.417 | 114.5 | 104.6 | 95.1 | 0.03 |
| | 4 | 19.0 | 10.5 | 5.3 | 1.81 | 1.98 | 12.4 | 3.84 | 3.89 | 2.59 | 0.407 | 109.7 | 100.3 | 93.2 | 0.08 |
| Comparative Ex. 1 | 5 | 18.7 | 10.4 | 5.2 | 1.80 | 2.00 | 12.3 | 3.88 | 3.92 | 2.64 | 0.405 | 106.3 | 97.3 | 92.7 | 0.18 |
| | 6 | 18.8 | 10.7 | 5.2 | 1.76 | 2.06 | 12.4 | 3.58 | 3.62 | 2.25 | 0.462 | 143.3 | 127.2 | 110.3 | 0.02 |

*1: Measured by the Microtracker Method.
$D_{+\sigma}$ The particle diameter in the particle size group with whose addition made in order of the particle size group (powder fraction) standard from the finest one the cumulative volume registers 84.13%.
$D_{50}$ The particle diameter in the particle size group with whose addition made in order of the particle size group standard from the finest one the cumulative volume registers 50% (50% particle diameter).
$D_{-\sigma}$ The particle diameter in the particle size group with whose addition made in order of the particle size group standard from the finest one the cumulative volume registers 16.87%.
$D_{+\sigma}/D_{50}$ The geometric standard deviation for all particle size group coarser than the 50% particle diameter.
$D_{50}/D_{-\sigma}$ The geometric standard deviation of all particle size groups finer than the 50% particle diameter.
MV The average particle size by volume (the average particle diameter).
*2: The density after tapping for 6 min. and 10 min., respectively.
*3: Measured by the BET Method.
*4: Apparent viscosity was measured by a flow tester (10 kg load, 1 mm diameter × 1 mm length die). "100P", "1,000P", and "10,000P" are defined to indicate respective temperature levels at which each of these viscosity levels is registered.

TABLE 3

| | No. | Chemical Analysis (%) C | Si | Mn | P | S | Ni | Cr | Remarks |
|---|---|---|---|---|---|---|---|---|---|
| Example 2 | 7 | 0.22 | 1.28 | 0.21 | 0.02 | 0.01 | 12.8 | 19.6 | Corresponds to SUS 304, JIS |
| | 8 | 0.45 | 1.32 | 0.23 | 0.02 | 0.01 | 12.7 | 19.7 | Corresponds to SUS 304, JIS |
| | 9 | 0.19 | 0.98 | 0.15 | 0.02 | 0.01 | — | 12.8 | Corresponds to SUS 410, JIS |
| | 10 | 0.52 | 0.99 | 0.13 | 0.02 | 0.01 | — | 12.8 | Corresponds to SUS 410, JIS |
| Comparative Examle 2 | 11 | 1.20 | 1.25 | 0.21 | 0.02 | 0.01 | 14.0 | 19.8 | Corresponds to SUS 304, JIS |
| | 12 | 0.02 | 0.95 | 0.13 | 0.02 | 0.01 | — | 12.9 | Corresponds to SUS 410, JIS |

TABLE 4

| | No. | Particle Size Distribution $D_{+\sigma}$ (μm) | $D_{50}$ (μm) | $D_{-\sigma}$ (μm) | $D_{+\sigma}/D_{50}$ | $D_{50}/D_{-\sigma}$ | MV (μm) | Tap Density (g/cc) min | Apparent Density (g/cc) | Specific Surface Area ($m^2/g$) | Viscosity Temperature (°C.) 100P | Carbon Content of Sintered Body (%) |
|---|---|---|---|---|---|---|---|---|---|---|---|---|
| Example 2 | 7 | 19.0 | 10.6 | 5.4 | 1.79 | 1.96 | 12.6 | 3.30 | 1.93 | 0.492 | 147.3 | 0.02 |
| | 8 | 18.9 | 10.4 | 5.2 | 1.82 | 2.00 | 12.4 | 3.42 | 2.36 | 0.457 | 134.2 | 0.03 |
| | 9 | 16.7 | 9.8 | 4.9 | 1.70 | 2.00 | 11.2 | 3.64 | 2.23 | 0.412 | 112.6 | 0.02 |
| | 10 | 16.5 | 9.7 | 4.8 | 1.70 | 2.02 | 11.0 | 3.77 | 2.59 | 0.401 | 101.3 | 0.03 |
| Comparative Example 2 | 11 | 19.2 | 10.5 | 5.3 | 1.83 | 1.98 | 12.5 | 3.12 | 1.79 | 0.501 | 160.1 | 0.02 |
| | 12 | 16.6 | 9.8 | 4.9 | 1.69 | 2.00 | 11.2 | 3.42 | 2.12 | 0.434 | 133.7 | 0.01 |

TABLE 5

| Cr-type Stainless Steel Powder | | | | | | | | | | | | | | | | |
|---|---|---|---|---|---|---|---|---|---|---|---|---|---|---|---|---|
| | Chemical Composition Corresponding to SUS 410, JIS (wt %) | | | | | | | | | | | | | | | |
| No. | O | C | Si | Mn | P | S | Cr | Ni | Mo | Cu | Sn | Se | Te | Al | N | Mn/Si |
| 1 | 0.30 | 0.01 | 0.20 | 0.22 | 0.02 | 0.01 | 13.0 | — | — | — | — | — | — | 0.002 | 0.040 | 1.1 |
| 2 | 0.76 | 0.01 | 0.30 | 0.08 | 0.02 | 0.01 | 13.0 | — | — | — | — | — | — | 0.010 | 0.030 | 0.3 |
| 3 | 0.62 | 0.02 | 0.30 | 0.32 | 0.02 | 0.01 | 13.0 | — | — | — | — | — | — | 0.005 | 0.036 | 1.1 |
| 4 | 0.76 | 0.02 | 0.30 | 3.60 | 0.02 | 0.01 | 13.0 | — | — | — | — | — | — | 0.004 | 0.030 | 12.0 |
| 5 | 0.79 | 0.02 | 0.70 | 0.20 | 0.02 | 0.01 | 13.0 | — | — | — | — | — | — | 0.002 | 0.032 | 0.3 |
| 6 | 0.28 | 0.02 | 0.70 | 0.60 | 0.02 | 0.01 | 13.0 | — | — | — | — | — | — | 0.012 | 0.036 | 0.9 |
| 7 | 0.33 | 0.02 | 0.70 | 0.80 | 0.02 | 0.01 | 13.0 | — | — | — | — | — | — | 0.010 | 0.035 | 1.1 |
| 8 | 0.31 | 0.02 | 0.71 | 1.00 | 0.02 | 0.01 | 13.0 | — | — | — | — | — | — | 0.002 | 0.034 | 1.4 |
| 9 | 0.31 | 0.01 | 0.73 | 2.03 | 0.02 | 0.01 | 13.4 | — | — | — | — | — | — | 0.006 | 0.026 | 2.8 |
| 10 | 0.27 | 0.01 | 0.72 | 4.00 | 0.02 | 0.01 | 13.2 | — | — | — | — | — | — | 0.005 | 0.038 | 5.6 |
| 11 | 0.27 | 0.01 | 3.80 | 4.00 | 0.02 | 0.01 | 14.1 | — | — | — | — | — | — | 0.002 | 0.066 | 1.1 |
| 12 | 0.63 | 0.01 | 0.74 | 0.88 | 0.02 | 0.01 | 28.8 | — | — | — | — | — | — | 0.001 | 0.084 | 1.2 |
| 13 | 0.32 | 0.02 | 0.75 | 0.96 | 0.02 | 0.01 | 8.2 | — | — | — | — | — | — | 0.003 | 0.026 | 1.3 |
| 14 | 0.51 | 0.15 | 0.70 | 0.91 | 0.02 | 0.01 | 13.0 | — | — | — | — | — | — | 0.006 | 0.036 | 1.3 |
| 15 | 0.40 | 0.45 | 0.72 | 0.80 | 0.02 | 0.01 | 13.0 | — | — | — | — | — | — | 0.003 | 0.042 | 1.1 |
| 16 | 0.40 | 0.90 | 0.68 | 0.80 | 0.02 | 0.01 | 13.0 | — | — | — | — | — | — | 0.005 | 0.046 | 1.2 |
| 17 | 0.57 | 1.15 | 0.70 | 0.80 | 0.02 | 0.01 | 13.0 | — | — | — | — | — | — | 0.001 | 0.046 | 1.1 |
| 18 | 0.49 | 1.25 | 0.70 | 0.80 | 0.02 | 0.01 | 13.0 | — | — | — | — | — | — | 0.002 | 0.050 | 1.1 |
| 19 | 0.39 | 1.50 | 0.20 | 0.80 | 0.02 | 0.01 | 13.0 | — | — | — | — | — | — | 0.010 | 0.050 | 4.0 |

TABLE 5-continued

| | Cr-type Stainless Steel Powder | | | | | | | | | | | | | | | |
|---|---|---|---|---|---|---|---|---|---|---|---|---|---|---|---|---|
| 20 | 0.30 | 0.02 | 0.70 | 1.00 | 0.02 | 0.01 | 13.0 | — | 0.50 | — | — | — | — | 0.003 | 0.036 | 1.4 |
| 21 | 0.54 | 0.02 | 0.70 | 1.00 | 0.02 | 0.01 | 13.0 | — | — | 2.00 | — | — | — | 0.005 | 0.035 | 1.4 |
| 22 | 0.79 | 0.02 | 0.70 | 1.00 | 0.02 | 0.01 | 13.0 | — | — | — | 0.70 | — | — | 0.006 | 0.034 | 1.4 |
| 23 | 0.56 | 0.02 | 0.70 | 1.00 | 0.02 | 0.01 | 13.0 | — | 0.50 | 2.00 | — | — | — | 0.001 | 0.032 | 1.4 |
| 24 | 0.67 | 0.02 | 0.70 | 1.00 | 0.02 | 0.01 | 13.0 | — | 0.50 | — | 0.70 | — | — | 0.002 | 0.033 | 1.4 |
| 25 | 0.62 | 0.02 | 0.70 | 1.00 | 0.02 | 0.01 | 13.0 | — | — | 2.00 | 0.70 | — | — | 0.002 | 0.040 | 1.1 |
| 26 | 0.70 | 0.02 | 0.70 | 1.00 | 0.02 | 0.25 | 13.0 | — | 0.50 | 2.00 | 0.70 | — | — | 0.004 | 0.034 | 1.4 |
| 27 | 0.45 | 0.02 | 0.70 | 1.00 | 0.02 | 0.02 | 13.0 | — | — | — | — | — | — | 0.004 | 0.030 | 1.4 |
| 28 | 0.33 | 0.02 | 0.70 | 1.00 | 0.02 | 0.02 | 13.0 | — | — | — | — | 0.06 | — | 0.001 | 0.031 | 1.4 |
| 29 | 0.38 | 0.02 | 0.70 | 1.00 | 0.02 | 0.25 | 13.0 | — | — | — | — | — | 0.06 | 0.004 | 0.030 | 1.4 |
| 30 | 0.48 | 0.02 | 0.70 | 1.00 | 0.02 | 0.25 | 13.0 | — | — | — | — | 0.06 | 0.06 | 0.003 | 0.033 | 1.4 |
| 31 | 0.70 | 0.02 | 0.70 | 1.00 | 0.02 | 0.25 | 13.0 | — | 0.50 | — | — | — | — | 0.004 | 0.034 | 1.4 |
| 32 | 0.39 | 0.02 | 0.70 | 1.00 | 0.02 | 0.25 | 13.0 | — | — | 2.00 | — | — | — | 0.005 | 0.035 | 1.4 |
| 33 | 0.49 | 0.02 | 0.70 | 1.00 | 0.02 | 0.25 | 13.0 | — | — | — | 0.70 | — | — | 0.004 | 0.035 | 1.4 |
| 34 | 0.37 | 0.02 | 0.70 | 1.00 | 0.02 | 0.25 | 13.0 | — | 0.50 | 2.00 | — | — | — | 0.005 | 0.033 | 1.4 |
| 35 | 0.37 | 0.02 | 0.70 | 1.00 | 0.02 | 0.25 | 13.0 | — | 0.50 | — | 0.70 | — | — | 0.004 | 0.033 | 1.4 |
| 36 | 0.37 | 0.02 | 0.70 | 1.00 | 0.02 | 0.25 | 13.0 | — | — | 2.00 | 0.70 | — | — | 0.004 | 0.032 | 1.4 |
| 37 | 0.58 | 0.02 | 0.70 | 1.00 | 0.02 | 0.25 | 13.0 | — | 0.50 | 2.00 | 0.70 | — | — | 0.004 | 0.036 | 1.4 |
| 38 | 0.47 | 1.10 | 0.70 | 1.00 | 0.02 | 0.25 | 13.0 | — | 0.50 | 2.00 | 0.70 | — | — | 0.004 | 0.050 | 1.4 |
| 39 | 0.23 | 0.01 | 0.70 | 1.00 | 0.02 | 0.01 | 5.0 | — | — | — | — | — | — | 0.004 | 0.037 | 1.4 |
| 40 | 0.45 | 0.01 | 0.70 | 1.00 | 0.02 | 0.01 | 7.0 | — | — | — | — | — | — | 0.004 | 0.044 | 1.4 |
| 41 | 0.33 | 0.01 | 0.70 | 1.00 | 0.02 | 0.01 | 8.0 | — | — | — | — | — | — | 0.004 | 0.046 | 1.4 |
| 42 | 0.56 | 0.01 | 0.70 | 1.00 | 0.02 | 0.01 | 10.0 | — | — | — | — | — | — | 0.004 | 0.040 | 1.4 |
| 43 | 0.48 | 0.01 | 0.70 | 1.00 | 0.02 | 0.01 | 11.0 | — | — | — | — | — | — | 0.004 | 0.041 | 1.4 |
| 44 | 0.30 | 0.01 | 0.70 | 1.00 | 0.02 | 0.01 | 18.0 | — | — | — | — | — | — | 0.004 | 0.057 | 1.4 |
| 45 | 0.35 | 0.01 | 0.70 | 1.00 | 0.02 | 0.01 | 20.0 | — | — | — | — | — | — | 0.004 | 0.081 | 1.4 |
| 46 | 0.36 | 0.01 | 0.70 | 1.00 | 0.02 | 0.01 | 23.0 | — | — | — | — | — | — | 0.004 | 0.085 | 1.4 |
| 47 | 0.28 | 0.01 | 0.70 | 1.00 | 0.02 | 0.01 | 25.0 | — | — | — | — | — | — | 0.004 | 0.088 | 1.4 |
| 48 | 0.39 | 0.01 | 0.70 | 1.00 | 0.02 | 0.01 | 30.0 | — | — | — | — | — | — | 0.004 | 0.100 | 1.4 |
| 49 | 0.35 | 0.01 | 0.70 | 1.00 | 0.02 | 0.01 | 33.0 | — | — | — | — | — | — | 0.004 | 0.110 | 1.4 |

| No. | Apparent Density ($g/cm^3$) | Tap Density ($g/cm^3$) | Viscosity Temperature (°C.) 100p | Particle Diameter (μm) | Density Ratio (%) | Carbon Content of Sintered Material (wt %) | Remarks |
|---|---|---|---|---|---|---|---|
| 1 | 2.45 | 3.60 | 103.1 | 8.8 | 95 | 0.010 | |
| 2 | 2.23 | 3.42 | 120.5 | 8.7 | 91 | 0.010 | Comparative Example |
| 3 | 2.46 | 3.61 | 103.0 | 8.8 | 95 | 0.010 | |
| 4 | 2.64 | 3.80 | 94.8 | 8.9 | 95 | 0.010 | |
| 5 | 2.22 | 3.40 | 125.0 | 8.8 | 91 | 0.010 | Comparative Example |
| 6 | 2.32 | 3.48 | 119.5 | 8.6 | 91 | 0.010 | Comparative Example |
| 7 | 2.45 | 3.60 | 103.0 | 8.6 | 95 | 0.010 | |
| 8 | 2.50 | 3.72 | 102.5 | 8.4 | 95 | 0.010 | |
| 9 | 2.58 | 3.86 | 100.5 | 8.3 | 95 | 0.010 | |
| 10 | 2.64 | 4.02 | 94.8 | 8.6 | 95 | 0.010 | |
| 11 | 2.46 | 3.60 | 103.2 | 8.4 | 95 | 0.010 | |
| 12 | 2.53 | 3.70 | 102.5 | 8.1 | 95 | 0.010 | |
| 13 | 2.54 | 3.76 | 101.5 | 8.7 | 95 | 0.010 | |
| 14 | 2.48 | 3.62 | 102.5 | 8.6 | 95 | 0.010 | |
| 15 | 2.55 | 3.75 | 101.0 | 8.5 | 95 | 0.020 | |
| 16 | 2.56 | 3.78 | 101.0 | 8.2 | 95 | 0.030 | |
| 17 | 2.62 | 3.98 | 100.5 | 8.9 | 95 | 0.040 | |
| 18 | 2.38 | 3.48 | 119.5 | 8.7 | 91 | 0.060 | Comparative Example |
| 19 | 2.30 | 3.44 | 120.0 | 8.1 | 90 | 0.080 | Comparative Example |
| 20 | 2.52 | 3.74 | 102.0 | 8.2 | 95 | 0.010 | |
| 21 | 2.53 | 3.74 | 102.0 | 8.8 | 95 | 0.010 | |
| 22 | 2.52 | 3.74 | 102.0 | 8.9 | 95 | 0.010 | |
| 23 | 2.54 | 3.76 | 101.5 | 8.2 | 95 | 0.010 | |
| 24 | 2.54 | 3.76 | 101.5 | 8.7 | 95 | 0.010 | |
| 25 | 2.45 | 3.60 | 103.1 | 8.8 | 95 | 0.010 | |
| 26 | 3.56 | 3.80 | 101.0 | 8.6 | 95 | 0.010 | |
| 27 | 2.54 | 3.76 | 101.5 | 8.3 | 95 | 0.010 | |
| 28 | 2.54 | 3.76 | 101.5 | 8.2 | 95 | 0.010 | |
| 29 | 2.54 | 3.76 | 101.5 | 8.9 | 95 | 0.010 | |
| 30 | 2.56 | 3.80 | 101.0 | 8.2 | 95 | 0.010 | |
| 31 | 2.54 | 3.76 | 101.5 | 8.4 | 95 | 0.010 | |
| 32 | 2.56 | 3.80 | 101.2 | 8.7 | 95 | 0.010 | |
| 33 | 2.54 | 3.76 | 101.5 | 8.7 | 95 | 0.010 | |
| 34 | 2.56 | 3.80 | 101.2 | 8.6 | 95 | 0.010 | |
| 35 | 2.56 | 3.80 | 101.2 | 8.4 | 95 | 0.010 | |
| 36 | 2.56 | 3.80 | 101.0 | 8.5 | 95 | 0.010 | |
| 37 | 2.58 | 3.86 | 101.0 | 8.9 | 95 | 0.010 | |
| 38 | 2.60 | 3.94 | 100.8 | 8.8 | 95 | 0.010 | |
| 39 | 2.52 | 3.74 | 102.0 | 8.4 | 95 | 0.010 | |
| 40 | 2.52 | 3.74 | 102.0 | 8.3 | 95 | 0.010 | |
| 41 | 2.52 | 3.74 | 102.0 | 8.3 | 95 | 0.010 | |
| 42 | 2.52 | 3.74 | 102.0 | 8.5 | 95 | 0.010 | |
| 43 | 2.52 | 3.64 | 102.0 | 8.6 | 95 | 0.010 | |
| 44 | 2.54 | 3.76 | 101.5 | 8.7 | 95 | 0.010 | |
| 45 | 2.54 | 3.76 | 101.5 | 8.6 | 95 | 0.010 | |
| 46 | 2.54 | 3.76 | 101.5 | 8.7 | 95 | 0.010 | |

TABLE 5-continued

| Cr-type Stainless Steel Powder | | | | | | |
|---|---|---|---|---|---|---|
| 47 | 2.54 | 3.76 | 101.5 | 8.6 | 95 | 0.010 |
| 48 | 2.56 | 3.80 | 101.2 | 8.9 | 95 | 0.010 |
| 49 | 2.56 | 3.80 | 101.2 | 8.9 | 95 | 0.010 |

TABLE 6

Cr-type Stainless Steel Powder

| | Chemical Composition (wt %) | | | | | | | | | | | Apparent Density |
|---|---|---|---|---|---|---|---|---|---|---|---|---|
| No. | O | C | Si | Mn | P | S | Cr | Ni | Al | N | Mn/Si | (g/cm$^3$) |
| 50 | 0.43 | 0.010 | 0.71 | 0.23 | 0.02 | 0.01 | 18.1 | 0.80 | 0.004 | 0.039 | 0.3 | 2.14 |
| 51 | 0.30 | 0.010 | 0.70 | 1.00 | 0.02 | 0.01 | 18.0 | 1.00 | 0.004 | 0.057 | 1.4 | 2.34 |
| 52 | 0.36 | 0.020 | 0.70 | 1.00 | 0.02 | 0.01 | 18.2 | 4.00 | 0.004 | 0.061 | 1.4 | 2.68 |
| 53 | 0.35 | 0.020 | 0.70 | 1.00 | 0.02 | 0.01 | 18.0 | 1.00 | 0.004 | 0.044 | 1.4 | 2.75 |
| 54 | 0.37 | 0.010 | 0.70 | 1.00 | 0.02 | 0.01 | 18.3 | 1.00 | 0.004 | 0.048 | 1.4 | 2.80 |

| No. | Tap Density (g/cm$^3$) | Average Particle Diameter (μm) | Compound Viscosity Temperature (°C.) 100p | Sintered Density Ratio (%) | Carbon Content of Sintered Material (wt %) | Corrosion Velosity of Sintered Material (g/m$^2$ · min) | Remarks |
|---|---|---|---|---|---|---|---|
| 50 | 3.40 | 8.5 | 125.0 | 91 | 0.010 | 35 | Comparative Example |
| 51 | 3.66 | 8.7 | 101.5 | 95 | 0.010 | 10 | |
| 52 | 4.08 | 12.5 | 100.0 | 94 | 0.010 | 0.4 | |
| 53 | 4.10 | 19.5 | 98.5 | 92 | 0.010 | 20 | |
| 54 | 4.15 | 21.5 | 98.0 | 91 | 0.010 | 50 | Comparative Example |

*Corrosion test condition; 25° C., 1% $H_2So_4$ solution × 8 hr

TABLE 7

Cr—Ni-type Stainless Steel Powder

| | Chemical Composition Corresponding to SUS 316, JIS (wt %) | | | | | | | | | | | | | | | |
|---|---|---|---|---|---|---|---|---|---|---|---|---|---|---|---|---|
| No. | O | C | Si | Mn | P | S | Cr | Ni | Mo | Cu | Sn | Se | Te | Al | N | Mn/Si |
| 55 | 0.23 | 0.01 | 0.22 | 0.12 | 0.02 | 0.01 | 18.0 | 14.0 | — | — | — | — | — | 0.003 | 0.036 | 0.5 |
| 56 | 0.33 | 0.02 | 0.20 | 0.25 | 0.02 | 0.01 | 18.2 | 14.1 | — | — | — | — | — | 0.002 | 0.041 | 1.3 |
| 57 | 0.68 | 0.01 | 0.34 | 0.40 | 0.02 | 0.01 | 18.2 | 14.0 | — | — | — | — | — | 0.004 | 0.032 | 1.7 |
| 58 | 0.88 | 0.01 | 0.32 | 0.85 | 0.02 | 0.01 | 18.1 | 14.3 | — | — | — | — | — | 0.003 | 0.038 | 3.9 |
| 59 | 0.82 | 0.02 | 0.74 | 0.55 | 0.02 | 0.01 | 18.0 | 14.1 | — | — | — | — | — | 0.005 | 0.033 | 0.7 |
| 60 | 0.43 | 0.01 | 0.76 | 0.80 | 0.02 | 0.01 | 18.0 | 14.3 | — | — | — | — | — | 0.004 | 0.030 | 1.1 |
| 61 | 0.36 | 0.01 | 0.70 | 1.00 | 0.02 | 0.01 | 18.1 | 14.2 | — | — | — | — | — | 0.002 | 0.046 | 1.4 |
| 62 | 0.64 | 0.02 | 0.70 | 1.98 | 0.02 | 0.01 | 18.3 | 14.0 | — | — | — | — | — | 0.005 | 0.051 | 2.8 |
| 63 | 0.59 | 0.08 | 0.70 | 0.83 | 0.02 | 0.01 | 18.5 | 14.4 | — | — | — | — | — | 0.003 | 0.042 | 1.2 |
| 64 | 0.58 | 0.50 | 0.70 | 0.80 | 0.02 | 0.01 | 18.1 | 14.4 | — | — | — | — | — | 0.002 | 0.036 | 1.1 |
| 65 | 0.32 | 1.04 | 0.72 | 0.81 | 0.02 | 0.01 | 18.2 | 14.0 | — | — | — | — | — | 0.004 | 0.062 | 1.1 |
| 66 | 0.51 | 1.30 | 0.72 | 0.83 | 0.02 | 0.01 | 18.4 | 14.0 | — | — | — | — | — | 0.001 | 0.034 | 1.2 |
| 67 | 0.49 | 0.02 | 0.73 | 6.51 | 0.02 | 0.01 | 18.2 | 3.0 | — | — | — | — | — | 0.001 | 0.066 | 8.9 |
| 68 | 0.38 | 0.02 | 0.72 | 9.55 | 0.02 | 0.01 | 18.5 | 6.0 | — | — | — | — | — | 0.004 | 0.080 | 13.3 |
| 69 | 0.62 | 0.02 | 0.75 | 0.85 | 0.02 | 0.01 | 26.3 | 22.0 | — | — | — | — | — | 0.002 | 0.106 | 1.1 |
| 70 | 0.29 | 0.01 | 0.72 | 0.84 | 0.02 | 0.01 | 18.0 | 14.4 | 2.96 | — | — | — | — | 0.003 | 0.040 | 1.2 |
| 71 | 0.48 | 0.01 | 0.76 | 0.88 | 0.02 | 0.01 | 19.6 | 14.6 | 4.00 | — | — | — | — | 0.004 | 0.033 | 1.2 |
| 72 | 0.45 | 0.02 | 0.71 | 0.86 | 0.02 | 0.01 | 18.8 | 14.4 | 2.66 | 2.40 | — | — | — | 0.001 | 0.041 | 1.2 |
| 73 | 0.37 | 0.01 | 0.73 | 0.93 | 0.02 | 0.01 | 18.6 | 14.2 | — | 4.86 | — | — | — | 0.001 | 0.038 | 1.3 |
| 74 | 0.35 | 0.02 | 0.74 | 0.96 | 0.02 | 0.01 | 18.6 | 14.4 | — | — | 0.75 | — | — | 0.004 | 0.038 | 1.3 |
| 75 | 0.31 | 0.01 | 0.72 | 1.03 | 0.02 | 0.01 | 18.4 | 14.0 | — | — | 8.00 | — | — | 0.003 | 0.033 | 1.4 |
| 76 | 0.33 | 0.02 | 0.73 | 0.98 | 0.02 | 0.01 | 18.2 | 14.2 | 2.60 | 2.36 | 0.74 | — | — | 0.002 | 0.034 | 1.3 |
| 77 | 0.36 | 0.02 | 0.74 | 1.00 | 0.02 | 0.25 | 18.3 | 14.4 | — | — | — | — | — | 0.003 | 0.036 | 1.4 |
| 78 | 0.38 | 0.01 | 0.76 | 1.02 | 0.02 | 0.02 | 18.1 | 14.2 | — | — | — | 0.08 | — | 0.004 | 0.034 | 1.3 |
| 79 | 0.38 | 0.01 | 0.71 | 0.99 | 0.02 | 0.02 | 18.3 | 14.4 | — | — | — | — | 0.06 | 0.004 | 0.035 | 1.4 |
| 80 | 0.51 | 0.01 | 0.70 | 0.89 | 0.02 | 0.46 | 18.3 | 14.0 | — | — | — | 0.20 | 0.20 | 0.003 | 0.042 | 1.3 |
| 81 | 0.42 | 0.02 | 0.73 | 0.98 | 0.02 | 0.22 | 18.4 | 14.2 | 2.56 | — | — | — | — | 0.002 | 0.035 | 1.3 |
| 82 | 0.38 | 0.02 | 0.77 | 0.96 | 0.02 | 0.23 | 18.3 | 14.4 | — | 2.44 | — | — | — | 0.001 | 0.032 | 1.2 |
| 83 | 0.50 | 0.02 | 0.72 | 0.97 | 0.02 | 0.24 | 18.2 | 14.3 | — | — | 0.75 | — | — | 0.002 | 0.032 | 1.3 |
| 84 | 0.43 | 0.02 | 0.75 | 0.98 | 0.02 | 0.22 | 18.2 | 14.2 | 2.68 | 2.56 | — | — | — | 0.001 | 0.036 | 1.3 |
| 85 | 0.31 | 0.02 | 0.76 | 0.94 | 0.02 | 0.24 | 18.3 | 14.4 | — | 2.48 | 0.76 | — | — | 0.004 | 0.034 | 1.2 |
| 86 | 0.35 | 0.02 | 0.73 | 0.96 | 0.02 | 0.23 | 18.4 | 14.3 | 2.66 | — | 0.74 | — | — | 0.004 | 0.033 | 1.3 |
| 87 | 0.36 | 0.02 | 0.73 | 0.98 | 0.02 | 0.23 | 18.5 | 14.2 | 2.64 | 2.50 | 0.74 | — | — | 0.003 | 0.038 | 1.3 |
| 88 | 0.33 | 0.52 | 0.71 | 0.95 | 0.02 | 0.22 | 18.6 | 14.4 | 2.65 | 2.51 | 0.75 | — | — | 0.002 | 0.057 | 1.3 |

| No. | Apparent Density (g/cm$^3$) | Tap Density (g/cm$^3$) | Average Particle Diameter (μm) | Compound Viscosity Temperature (°C.) 100p | Sintered Density Ratio (%) | Carbon Content of Sintered Material (wt %) | Remarks |
|---|---|---|---|---|---|---|---|
| 55 | 2.20 | 3.40 | 8.6 | 125.0 | 91 | 0.010 | Comparative Example |
| 56 | 2.50 | 3.70 | 8.3 | 103.0 | 95 | 0.010 | |

TABLE 7-continued

| Cr—Ni-type Stainless Steel Powder | | | | | | | |
|---|---|---|---|---|---|---|---|
| 57 | 2.54 | 3.76 | 8.1 | 101.0 | 95 | 0.010 | |
| 58 | 2.58 | 3.86 | 8.4 | 100.8 | 95 | 0.010 | |
| 59 | 2.30 | 3.44 | 8.7 | 120.0 | 91 | 0.010 | Comparative Example |
| 60 | 2.44 | 3.56 | 8.6 | 105.3 | 95 | 0.010 | |
| 61 | 2.50 | 3.64 | 8.7 | 103.0 | 95 | 0.010 | |
| 62 | 2.58 | 3.80 | 8.6 | 100.5 | 95 | 0.010 | |
| 63 | 2.54 | 3.72 | 8.9 | 101.0 | 95 | 0.010 | |
| 64 | 2.60 | 3.90 | 8.2 | 100.2 | 95 | 0.030 | |
| 65 | 2.62 | 3.90 | 8.4 | 98.0 | 95 | 0.050 | |
| 66 | 2.36 | 3.44 | 8.4 | 120.0 | 90 | 0.070 | Comparative Example |
| 67 | 2.68 | 3.96 | 8.7 | 98.0 | 95 | 0.010 | |
| 68 | 2.68 | 3.97 | 8.4 | 97.8 | 95 | 0.010 | |
| 69 | 2.60 | 3.90 | 8.2 | 100.5 | 95 | 0.010 | |
| 70 | 2.50 | 3.64 | 8.3 | 102.0 | 95 | 0.010 | |
| 71 | 2.54 | 3.70 | 8.8 | 101.0 | 95 | 0.010 | |
| 72 | 2.56 | 3.76 | 8.5 | 101.0 | 95 | 0.010 | |
| 73 | 2.56 | 3.76 | 8.7 | 101.0 | 95 | 0.010 | |
| 74 | 2.52 | 3.70 | 8.4 | 102.0 | 95 | 0.010 | |
| 75 | 2.54 | 3.76 | 8.8 | 101.5 | 95 | 0.010 | |
| 76 | 2.56 | 3.76 | 8.7 | 101.2 | 95 | 0.010 | |
| 77 | 2.58 | 3.80 | 8.9 | 101.2 | 95 | 0.010 | |
| 78 | 2.54 | 3.70 | 8.8 | 101.5 | 95 | 0.010 | |
| 79 | 2.53 | 3.68 | 8.9 | 101.8 | 95 | 0.010 | |
| 80 | 2.60 | 3.90 | 8.6 | 99.8 | 95 | 0.010 | |
| 81 | 2.60 | 3.90 | 8.5 | 100.2 | 95 | 0.010 | |
| 82 | 2.58 | 3.80 | 8.2 | 101.0 | 95 | 0.010 | |
| 83 | 2.56 | 3.76 | 8.3 | 101.2 | 95 | 0.010 | |
| 84 | 2.64 | 3.92 | 8.7 | 99.8 | 95 | 0.010 | |
| 85 | 2.62 | 3.90 | 8.2 | 101.0 | 95 | 0.010 | |
| 86 | 2.62 | 3.90 | 8.8 | 99.8 | 95 | 0.010 | |
| 87 | 2.64 | 3.92 | 8.7 | 99.5 | 95 | 0.010 | |
| 88 | 2.68 | 3.96 | 8.8 | 98.0 | 95 | 0.010 | |

TABLE 8

| Cr-type Stainless Steel Powder | | | | | | | | | | | | |
|---|---|---|---|---|---|---|---|---|---|---|---|---|
| | Chemical Composition (wt %) | | | | | | | | | | | Apparent Density |
| No. | O | C | Si | Mn | P | S | Co | V | B | N | Mn/Si | (g/cm$^3$) |
| *1 | 0.35 | 0.01 | 0.012 | 0.010 | 0.013 | 0.015 | 50.3 | — | — | 0.0046 | 0.83 | 2.44 |
| 2 | 0.37 | 0.01 | 0.014 | 0.021 | 0.010 | 0.012 | 50.0 | — | — | 0.0042 | 1.50 | 2.55 |
| 3 | 0.32 | 0.01 | 0.008 | 0.13 | 0.010 | 0.010 | 50.0 | — | — | 0.0036 | 16.3 | 2.68 |
| 4 | 0.34 | 0.01 | 0.010 | 1.00 | 0.010 | 0.010 | 50.1 | — | — | 0.0060 | 100.0 | 2.74 |
| 5 | 0.33 | 0.01 | 0.011 | 2.00 | 0.010 | 0.011 | 50.0 | — | — | 0.0080 | 181.1 | 2.76 |
| 6 | 0.38 | 0.01 | 0.012 | 2.20 | 0.010 | 0.010 | 50.2 | — | — | 0.0086 | 183.3 | 2.76 |
| 7 | 0.36 | 0.01 | 0.042 | 0.12 | 0.015 | 0.013 | 50.5 | — | — | 0.0060 | 2.86 | 2.66 |
| 8 | 0.37 | 0.01 | 0.063 | 0.25 | 0.012 | 0.010 | 50.3 | — | — | 0.0068 | 3.97 | 2.71 |
| 9 | 0.38 | 0.02 | 0.15 | 0.86 | 0.012 | 0.012 | 50.2 | — | — | 0.0094 | 5.73 | 2.73 |
| 10 | 0.30 | 0.01 | 0.96 | 2.00 | 0.010 | 0.015 | 50.1 | — | — | 0.0160 | 2.08 | 2.59 |
| 11 | 0.34 | 0.01 | 0.96 | 2.60 | 0.010 | 0.015 | 50.2 | — | — | 0.0138 | 2.71 | 2.65 |
| *12 | 0.39 | 0.01 | 0.18 | 0.080 | 0.010 | 0.012 | 50.2 | — | — | 0.0045 | 0.44 | 2.40 |
| 13 | 0.38 | 0.12 | 0.045 | 0.080 | 0.010 | 0.011 | 50.0 | — | — | 0.0087 | 1.78 | 2.61 |
| 14 | 0.30 | 0.55 | 0.044 | 0.10 | 0.011 | 0.012 | 50.2 | — | — | 0.0130 | 2.27 | 2.65 |
| 15 | 0.39 | 0.98 | 0.043 | 0.12 | 0.011 | 0.012 | 50.1 | — | — | 0.0200 | 2.67 | 2.73 |
| 16 | 0.37 | 1.06 | 0.12 | 0.25 | 0.010 | 0.008 | 50.2 | — | — | 0.0306 | 2.08 | 2.40 |
| 17 | 0.40 | 0.01 | 0.043 | 0.086 | 0.012 | 0.012 | 15.5 | — | — | 0.0084 | 2.00 | 2.63 |
| 18 | 0.38 | 0.01 | 0.042 | 0.095 | 0.012 | 0.010 | 60.0 | — | — | 0.0096 | 2.26 | 2.65 |
| 19 | 0.40 | 0.02 | 0.21 | 0.29 | 0.012 | 0.008 | 49.2 | 1.22 | — | 0.0053 | 1.38 | 2.52 |
| 20 | 0.39 | 0.02 | 0.20 | 0.35 | 0.011 | 0.010 | 49.4 | 2.01 | — | 0.0056 | 1.75 | 2.65 |
| 21 | 0.33 | 0.01 | 0.20 | 0.33 | 0.012 | 0.008 | 49.1 | 3.98 | — | 0.0064 | 1.65 | 2.55 |
| 22 | 0.34 | 0.01 | 0.20 | 0.33 | 0.012 | 0.008 | 49.1 | 4.50 | — | 0.0080 | 1.65 | 2.53 |
| *23 | 0.32 | 0.01 | 0.20 | 0.084 | 0.012 | 0.010 | 49.4 | 2.01 | — | 0.0051 | 0.42 | 2.40 |
| 24 | 0.37 | 0.01 | 0.043 | 0.12 | 0.010 | 0.011 | 50.3 | — | 0.025 | 0.0063 | 2.79 | 2.71 |
| 25 | 0.36 | 0.02 | 0.041 | 0.13 | 0.010 | 0.012 | 50.1 | — | 0.45 | 0.0340 | 3.17 | 2.75 |
| 26 | 0.38 | 0.01 | 0.042 | 0.10 | 0.011 | 0.010 | 50.0 | — | 0.96 | 0.0360 | 2.38 | 2.76 |
| 27 | 0.42 | 0.01 | 0.043 | 0.12 | 0.011 | 0.010 | 50.0 | — | 1.56 | 0.0650 | 2.79 | 2.65 |
| 28 | 0.36 | 0.02 | 0.044 | 0.13 | 0.052 | 0.010 | 50.1 | — | — | 0.0045 | 2.95 | 2.68 |
| 29 | 0.42 | 0.01 | 0.043 | 0.11 | 0.48 | 0.015 | 50.2 | — | — | 0.0073 | 2.56 | 2.71 |
| 30 | 0.49 | 0.01 | 0.045 | 0.14 | 0.97 | 0.018 | 50.2 | — | — | 0.0065 | 3.11 | 2.73 |
| 31 | 0.40 | 0.01 | 0.042 | 0.12 | 1.20 | 0.020 | 50.1 | — | — | 0.0048 | 2.86 | 2.62 |
| 32 | 0.37 | 0.01 | 0.020 | 0.20 | 0.45 | 0.010 | 49.0 | 2.01 | — | 0.0070 | 10.0 | 2.73 |
| 33 | 0.35 | 0.01 | 0.021 | 0.20 | 0.43 | 0.010 | 49.1 | 2.02 | 0.95 | 0.0065 | 9.5 | 2.78 |
| *34 | 0.38 | 0.01 | 0.041 | 0.020 | 0.010 | 0.010 | 50.0 | — | — | 0.0050 | 0.49 | 2.02 |
| 35 | 0.34 | 0.01 | 0.043 | 0.12 | 0.011 | 0.008 | 50.2 | — | — | 0.0080 | 2.79 | 2.52 |
| 36 | 0.32 | 0.01 | 0.042 | 0.12 | 0.015 | 0.013 | 50.2 | — | — | 0.0060 | 2.86 | 2.66 |
| 37 | 0.36 | 0.01 | 0.040 | 0.11 | 0.011 | 0.010 | 50.0 | — | — | 0.0040 | 2.83 | 2.68 |
| 38 | 0.35 | 0.01 | 0.044 | 0.13 | 0.010 | 0.010 | 50.0 | — | — | 0.0036 | 2.90 | 2.70 |
| 39 | 0.38 | 0.01 | 0.041 | 0.11 | 0.012 | 0.010 | 50.1 | — | — | 0.0050 | 2.75 | 2.70 |
| 40 | 0.32 | 0.01 | 0.043 | 0.11 | 0.012 | 0.008 | 50.0 | — | — | 0.0037 | 2.55 | 2.74 |

TABLE 8-continued

| | | | | | | | | | | | | |
|---|---|---|---|---|---|---|---|---|---|---|---|---|
| Cr-type Stainless Steel Powder | | | | | | | | | | | | |
| 41 | 0.39 | 0.01 | 0.042 | 0.11 | 0.012 | 0.010 | 50.3 | — | — | 0.0046 | 2.68 | 2.80 |
| 42 | 0.32 | 0.01 | 0.042 | 0.12 | 0.011 | 0.010 | 50.2 | — | — | 0.0051 | 2.90 | 2.85 |
| *43 | 0.36 | 0.01 | 0.040 | 0.12 | 0.010 | 0.010 | 50.0 | — | — | 0.0057 | 2.88 | 3.00 |

| | Tap Density (g/cm³) | Average Particle Diameter (μm) | Compound Viscosity Temperature (°C.) 100p | Relative Density Ratio % | Carbon Content of Sintered Material (wt %) | Magnetic Characteristics Bs (kG) | μ max | Hc (Oe) |
|---|---|---|---|---|---|---|---|---|
| *1 | 3.46 | 9.5 | 120.0 | 90 | 0.010 | 16.0 | 2500 | 3.5 |
| 2 | 3.76 | 9.7 | 105.6 | 95 | 0.010 | 22.3 | 9200 | 1.1 |
| 3 | 3.86 | 9.9 | 102.6 | 95 | 0.005 | 21.2 | 8500 | 1.2 |
| 4 | 4.02 | 9.9 | 95.0 | 95 | 0.008 | 19.5 | 7000 | 1.6 |
| 5 | 4.06 | 9.8 | 94.6 | 93 | 0.010 | 15.8 | 5000 | 2.0 |
| 6 | 4.06 | 9.6 | 94.8 | 91 | 0.010 | 14.8 | 3800 | 3.3 |
| 7 | 3.85 | 9.0 | 102.5 | 95 | 0.010 | 20.3 | 7000 | 1.7 |
| 8 | 3.99 | 9.1 | 97.5 | 95 | 0.010 | 19.5 | 6000 | 1.8 |
| 9 | 4.01 | 9.9 | 95.6 | 95 | 0.010 | 16.5 | 4000 | 2.0 |
| 10 | 3.81 | 9.7 | 104.8 | 95 | 0.010 | 15.6 | 3500 | 2.4 |
| 11 | 3.80 | 9.5 | 110.2 | 95 | 0.010 | 14.3 | 1800 | 4.0 |
| *12 | 3.42 | 9.8 | 124.5 | 89 | 0.010 | 14.7 | 3000 | 3.8 |
| 13 | 3.81 | 9.2 | 103.2 | 95 | 0.012 | 21.8 | 7500 | 1.6 |
| 14 | 3.84 | 9.2 | 103.0 | 95 | 0.015 | 21.5 | 7000 | 1.5 |
| 15 | 4.01 | 9.4 | 95.0 | 95 | 0.017 | 21.0 | 5500 | 1.8 |
| 16 | 3.43 | 9.5 | 129.5 | 90 | 0.045 | 14.5 | 2000 | 4.7 |
| 17 | 3.80 | 9.8 | 103.5 | 95 | 0.010 | 20.5 | 4000 | 2.0 |
| 18 | 3.84 | 9.4 | 103.0 | 95 | 0.010 | 22.1 | 9000 | 1.3 |
| 19 | 3.61 | 9.4 | 106.0 | 95 | 0.010 | 19.9 | 4900 | 1.7 |
| 20 | 3.62 | 9.2 | 105.6 | 95 | 0.010 | 18.5 | 4500 | 1.9 |
| 21 | 3.60 | 9.6 | 107.0 | 95 | 0.010 | 15.5 | 3500 | 2.0 |
| 22 | 3.58 | 9.5 | 111.0 | 95 | 0.010 | 14.5 | 2500 | 3.8 |
| *23 | 3.50 | 9.5 | 125.0 | 90 | 0.010 | 14.5 | 2000 | 4.4 |
| 24 | 3.99 | 9.4 | 97.3 | 96 | 0.010 | 21.5 | 8500 | 1.4 |
| 25 | 4.05 | 9.4 | 95.0 | 98 | 0.010 | 22.2 | 9000 | 1.2 |
| 26 | 4.06 | 9.2 | 94.8 | 98 | 0.010 | 23.0 | 11000 | 1.0 |
| 27 | 3.80 | 9.5 | 110.2 | 95 | 0.010 | 13.3 | 1000 | 3.2 |
| 28 | 3.86 | 9.5 | 102.8 | 96 | 0.010 | 21.0 | 8000 | 1.6 |
| 29 | 3.96 | 9.1 | 97.4 | 96 | 0.010 | 21.3 | 8300 | 1.4 |
| 30 | 4.01 | 9.9 | 95.0 | 98 | 0.010 | 22.0 | 9000 | 1.2 |
| 31 | 3.80 | 9.5 | 113.2 | 96 | 0.010 | 15.0 | 3500 | 3.0 |
| 32 | 4.02 | 9.4 | 95.0 | 97 | 0.010 | 18.0 | 6000 | 1.8 |
| 33 | 4.03 | 9.8 | 94.8 | 98 | 0.010 | 18.0 | 7000 | 1.6 |
| *34 | 3.30 | 5.7 | 138.5 | 91 | 0.010 | 15.0 | 3000 | 3.2 |
| 35 | 3.52 | 5.5 | 109.5 | 98 | 0.010 | 23.5 | 12000 | 1.1 |
| 36 | 3.85 | 9.0 | 102.5 | 96 | 0.010 | 21.3 | 8000 | 1.4 |
| 37 | 4.01 | 10.5 | 100.0 | 95 | 0.010 | 21.0 | 7500 | 1.5 |
| 38 | 4.06 | 11.2 | 99.5 | 95 | 0.010 | 20.6 | 7000 | 1.7 |
| 39 | 4.08 | 12.3 | 99.5 | 94 | 0.010 | 20.0 | 6000 | 1.9 |
| 40 | 4.10 | 13.6 | 98.0 | 94 | 0.010 | 20.0 | 6000 | 1.9 |
| 41 | 4.14 | 15.5 | 95.5 | 93 | 0.010 | 19.0 | 4000 | 2.4 |
| 42 | 4.20 | 19.8 | 93.5 | 92 | 0.010 | 17.5 | 3500 | 2.8 |
| *43 | 4.22 | 21.0 | 91.5 | 86 | 0.010 | 15.0 | 2000 | 3.4 |

*Comparative Example

As have been described in detail in the foregoing, according to the present invention, there is provided a sintered material having relative density ratio of 92% or higher whose injection moldability and sinterability are improved by achieving spherical particle formation by means of atomizing the melt whose composition is so adjusted that the carbon content, the silicon content, the manganese content and the Manganese/Silicon ratio will become 1.00% or less by weight, 1.00% or less by weight, 2.00% or less by weight and 1.00 or higher, respectively from Iron-Cobalt-type and Iron-Cobalt-Vanadium-type alloy melts, to obtain fine powder of an average particle diameter of 20 microns or less.

According to the present invention, there are provided Iron-Cobalt-type and Iron-Cobalt-Vanadium-type alloy powders with remarkably improved injection moldability and sinterability by dint of improved spherical particle formation by atomizing into powders of the average particle diameter of 20 microns or less the melt with which one or both of 0.02 to 1.00% by weight of boron and 0.05 to 1.00% by weight of phosphorus is or are alloyed.

Moreover, there is provided a sintered material which has a relative density ratio of 92% or higher and excellent magnetic characteristics by using the above-mentioned powders.

We claim:

1. An iron-cobalt based alloy steel powder for injection-molding use, wherein the alloy steel powder is adapted to be injection-molded after blending the alloy steel powder with an organic binder and the injection-molded article is subsequently debound and sintered at a sintering temperature in the range of 1350° C. or more, said alloy steel powder comprising spherically-shaped, water atomized particles of an average particle diameter of 20 μm or less, said alloy steel consisting of 0.01 to 1.00% by weight of carbon;

0.01 to 1.00% by weight of silicon;

0.01 to 2.00% by weight of manganese, wherein the manganese/silicon ratio is 1.00 or greater;

15.0 to 60.0% by weight of cobalt;
at least one optional element selected from the group consisting of 1.0 to 4.0% by weight of vanadium,
0.02 to 1.00% by weight of boron,
0.05 to 1.00% by weight of phosphorus, and
the balance of iron and incidental impurities.

2. The iron-cobalt based alloy steel powder according to claim 1 wherein the powder has been produced by water-atomization using a highly pressurized water comprising the steps of a) providing a melt of the steel, and b) atomizing the melt by means of a water jet.

* * * * *